United States Patent [19]

Brown

[11] Patent Number: 4,783,911

[45] Date of Patent: Nov. 15, 1988

[54] SKATE BOOT ASSEMBLY

[76] Inventor: Dennis N. Brown, 8528 Custer School Rd., Custer, Wash. 98240

[21] Appl. No.: 899,958

[22] Filed: Aug. 25, 1986

[51] Int. Cl.[4] ..... A43B 13/38; A43B 7/22; A43B 5/04

[52] U.S. Cl. ..... 36/115; 36/44; 36/91

[58] Field of Search ..... 36/115, 43, 44, 10, 36/117, 119, 88, 93, 15; 280/11.1 R, 11.12, 11.14, 11.17, 11.18

[56] References Cited

U.S. PATENT DOCUMENTS

| | | | |
|---|---|---|---|
| 2,120,987 | 6/1938 | Murray | 12/142 |
| 2,147,455 | 2/1939 | Murray | 36/2.5 |
| 3,325,919 | 6/1967 | Robinson | 36/93 |
| 3,486,247 | 12/1969 | Franet | 36/119 |
| 3,640,003 | 2/1972 | Anderson | 36/119 |
| 3,934,892 | 1/1976 | Baikie | 280/11.12 |
| 3,939,583 | 2/1976 | Dalmann | 36/115 |
| 4,253,251 | 3/1981 | Salomon | 36/119 |
| 4,328,627 | 5/1982 | Sanders | 36/115 |
| 4,351,537 | 9/1982 | Seidel | 280/11.12 |
| 4,353,173 | 10/1982 | Paquet | 36/115 |
| 4,385,456 | 5/1983 | Livernois et al. | 36/115 |
| 4,413,430 | 11/1983 | Brown | 36/115 |
| 4,453,727 | 6/1984 | Bourque | 280/11.12 |
| 4,509,276 | 4/1985 | Bourque | 36/115 |
| 4,520,580 | 6/1985 | Brown | 36/115 |
| 4,534,122 | 8/1985 | MacPhail | 36/119 |
| 4,655,465 | 4/1987 | Schaeffer | 36/115 |

FOREIGN PATENT DOCUMENTS

| | | | |
|---|---|---|---|
| 3043425 | 7/1982 | Fed. Rep. of Germany | 36/115 |
| 706305 | 3/1931 | France | 36/15 |
| 2492233 | 4/1982 | France | 36/119 |
| 321074 | 4/1957 | Switzerland | 36/119 |

*Primary Examiner*—Steven N. Meyers

*Attorney, Agent, or Firm*—Hughes, Cassidy & Multer

[57] ABSTRACT

A skate boot assembly comprising a main skate boot member, a bladder positioned within the boot member, and an orthotic insert positioned within the bladder. The orthotic insert is formed with two downwardly extending protrusions which fit in recesses formed in a sole portion of the bladder. The bladder in turn has downwardly protruding members that define its recesses and also fit into matching recesses formed in the sole of the boot member. This arrangement properly aligns the foot with the skate blade and with the longitudinal axis of the boot assembly. Further, the bladder is formed with properly positioned relief areas to alleviate unwanted foot pressure in certain areas, and also engages the upper heel portion of the foot to properly maintain the foot in the boot assembly. Other protrusion and recess means are provided between the bladder and the boot member so as to properly position the same relative to each other.

116 Claims, 9 Drawing Sheets

SKATE BOOT ASSEMBLY

BACKGROUND OF THE INVENTION

1. Field of the Invention The present invention relates to a boot assembly, and more particularly to a skate boot assembly where an orthotic insert is used in a particularly advantageous way to properly center, align, and support the foot from the blade of the skate through the main boot member.

2. Background Art

The structuring of a skate boot involves some design considerations that are somewhat different from designing ordinary footware. The base support structure is an elongate quite narrow metal blade that engages the ice surface. Thus, the support force transmitted from the ice is essentially along a single narrow line, and this force emanates upwardly from this line contact and also laterally to provide support over a broader area corresponding to the lower surface of the person's foot.

To the best knowledge of the applicant, the general design philosophy for prior art skate boots is to provide the blade structure, then design the boot, and then provide the interface of the blade with the boot so that the forces from the lower edge of the blade can be transmitted through the boot to the plantar surface of the person's foot. Finally, consideration is given to providing a comfortable fit of the person's foot in the boot.

With regard to the general subject of footwear, it has long been known that in many instances the operation of the foot can be improved by u of a proper orthotic. Quite often, the orthotic is in the form of an insert which can be paced in an existing shoe. An orthotic insert can be either soft or hard. A hard insert is a substantially rigid member, desirably having a relatively thin vertical thickness dimension and extending from the calcaneus area of the foot (the heel portion) to at least the metatarsal head area of the foot (i.e. that area at the "ball" of the foot). In general, the purpose of a rigid orthotic (sometimes called a functional orthotic) is to first position, and then to control the movements of, the midtarsal and subtalar joints during the gait cycle which the body goes through in walking and running, and also possibly for other movements.

However, the gait cycle which a person goes through in walking or running is somewhat different from the cycle which the person's foot goes through when ice skating. Thus, in providing an orthotic for ice skating, while there are many considerations that are common to providing an orthotic insert design for walking and running, there are, however, some special considerations for the ice skating motion. Further, to the best knowledge of the applicant, many of the design approaches for skate boots undertaken in the prior art have failed to appreciate the relationship of the dynamics of the foot in the skating motion, relative to the overall structure and operation of the skate boot.

A search of the patent literature has disclosed a number of skate boots of various configurations. These are as follows.

U.S. Pat. No. 4,453,727, Bourque, illustrates a skate boot for goal tenders. The blade support is made with a filler portion which functions as a foot protector means.

U.S. Pat. No. 4,351,537, Seidel, provides a skate boot having a support structure which supports the steel runner. A soft flexible sock is attached to the molded support and receives the skater's foot. There is a removable cover portion which is adapted to meet the molded support structure to fully enclose the sock and to thereby protect the skater's foot.

U.S. Pat. No. 4,328,627, Sanders, shows a roller skate where the foot support portion is formed as a relatively rigid member. There is provided a plurality of attachments which allow the shoe to be used in ice skating, mountain climbing and skiing applications.

U.S. Pat. No. 3,934,892, Baikie, has a skate boot where the supporting structure for the blade comprises two walls which extend from the sole downwardly and inwardly to the location of the blade.

U.S. Pat. No. 2,147,455, Murray, discloses a metal slipper that is formed around a mold of the user's foot. The blade of the skate is then welded to the slipper and the shoe formed around the metal form.

U.S. Pat. No. 2,120,987, Murray, illustrates a shoe that is formed of a plastic material, and the blade is vulcanized to the shoe structure.

SUMMARY OF THE INVENTION

The present invention relates to a boot assembly, and also to various components and subcombinations of this boot assembly. In the preferred form of the invention, the boot assembly is a skate boot assembly. The main components of the overall invention are the following:

a. a main boot member defining a foot receiving cavity and comprising a lower sole portion, a toe portion, a heel portion and two side portions;

b. a bladder adapted to be positioned in said boot cavity and made at least in part of a moderately yielding material, the bladder comprising the sole portion and side and heel portions extending upwardly from the sole portion of the bladder;

c. an orthotic insert having a longitudinal alignment axis and adapted to be positioned in the foot receiving cavity of the boot above the sole portion of the bladder, the insert having an upwardly facing surface contoured to engage a plantar surface of a foot in a manner to align the foot with the longitudinal alignment axis of the insert.

In accordance with a preferred embodiment of the present invention, where the boot assembly is provided as a skate boot assembly, there is a skate blade which has a lengthwise axis and which is rigidly attached to the main boot member at a location below the sole portion of the boot member. The lengthwise blade axis is aligned with, and centered on, the longitudinal center axis of the assembly.

A significant feature of the present invention is that the assembly (whether a skate boot assembly or other boot assembly) is arranged with first interfitting protrusion and recess means to restrain at least the orthotic insert relative to the sole portion of the boot member with regard to movement in a horizontal plane, and to align the longitudinal alignment axis of the insert with the longitudinal center axis of the boot assembly.

In the preferred form of the bladder of the present invention, the bladder has inwardly extending ankle engaging means to engage a rear ankle portion of a person's foot above a heel portion of the foot and on opposite sides of an Achilles tendon of an ankle/heel portion of the foot.

In the preferred form of the bladder and boot member, these are provided with a second interfitting protrusion and recess means to restrain upward movement of the heel portion of the bladder relative to the boot member. Likewise, in a preferred form, a toe portion of the bladder and the toe portion of the boot have further interfitting protrusion and recess means to restrain relative movement between the toe portion of the bladder and the toe portion of the boot member.

In the specific configuration shown herein, the sole portion of the boot member is provided with the recess means, and the insert is provided with downwardly extending protrusion means interfitting with the recess means of the sole portion of the boot member. Additionally, in the referred form, the bladder has protrusion and recess means which provide a recess to receive the protrusion means of the insert, and extending into the recess means of the sole portion of the boot member. Further, in the preferred form, the protrusion means of the insert comprises at least a forward protrusion portion and a rear protrusion portion, and the recess means of the boot member comprises at least a forward recess portion and a rear recess portion interfitting with the forward and rear protrusion portions of the insert.

As a further feature of the present invention, there is a tongue section positioned to extend over at least an upper midfoot portion of the foot. The main boot member has two side walls having upper edge portions. The tongue section has an upwardly raised middle tongue portion adapted to engage the upper edge portions of the two boot side walls, whereby the tongue section can be centered relative to the main boot member. Desirably, the tongue and raised middle tongue portion extend over the midfoot portion of the foot, and in a further preferred form, extend upwardly over a forward ankle portion of the foot. In the preferred form, the tongue section is formed as part of the bladder.

Another feature of the present invention is to provide the tongue section with right and left tongue portions which are formed with an adjustable connecting means, permitting the right and left tongue portions to be joined at a location further from each other, or a location closer to each other. Desirably, the two tongue portions are formed as flap portions adapted to overlie one another, with the flap portions being formed with connecting surface portions. Desirably, the two flap portions are formed with the upwardly raised area positioned to engage the upper edge portions of the two side walls of the boot member.

The preferred form of the bladder is such that the bladder is provided with at least one inside relief area and desirably a plurality of such relief areas.

One relief area is at a location at a juncture of the midfoot tongue portion and the upper ankle tongue portion, thus permitting moderate flexing of the person's foot, without creating undue localized pressure. Another relief area is formed at a position to be located adjacent an inner side portion of the foot adjacent a first metatarsal phalangial joint. A further relief area is located at an outer forward side portion of the bladder positioned to be adjacent a fifth metatarsal phalangial joint of the foot. Yet another relief area is at an inside surface of a top midfoot portion of the bladder, this relief area being positioned to be adjacent a dorsalis pedis artery and vein of the foot. Finally, the bladder is formed with an inside relief area at a rear inner portion of the bladder, the relief area being positioned so as to be adjacent a posterior tibial artery of the foot.

Further, the main boot member can be provided with groove means extending from a rear boot ankle portion around the side boot ankle portions. The groove means has a vertical width dimension, and in one configuration, the width dimension of the groove is greater at a rear location and less at a forward location. In another configuration, the width dimension is less at a rear location of the grooves, and greater at a forward location of the grooves. In another arrangement, at least some of the grooves have a cross-sectional configuration transverse to the lengthwise axis of the groove of a V-shape.

In a subcombination of the present invention, the boot assembly comprises a main boot member and a bladder positioned in the boot cavity, with the bladder in the preferred form having the characteristics as noted above. Further, the present invention contemplates as an inventive entity a bladder having characteristics such as those recited above, with this bladder being adapted to be positioned into a boot member. Also, the resent invention encompasses the subcombination of a boot member and an interfitting orthotic, with the boot member and the orthotic having interfitting protrusion and recess means to restrain relative movement of the orthotic insert relative to the sole portion of the boot member with regard to movement in a horizontal plane.

Other features of the present invention will become apparent from the following detailed description.

DESCRIPTION OF THE PREFERRED EMBODIMENTS

It is believed that a clearer understanding of the present invention will be achieved by first discussing generally some background information: (a) the main components or parts of the human leg and foot and how these function relative to one another; (b) the gait cycle which a person goes through in a normal walking motion; and (c) the intended function of a rigid orthotic in optimizing the coordinated operation of the person's foot and leg throughout the gait cycle. Following this, there will be a discussion of the cycle which the person goes through in the normal ice skating motion, and the dynamics of the foot during this cycle, after which the skate boot assembly of the present invention will be described.

For convenience, these various topics will be discussed under appropriate subheadings.

Figure 1:
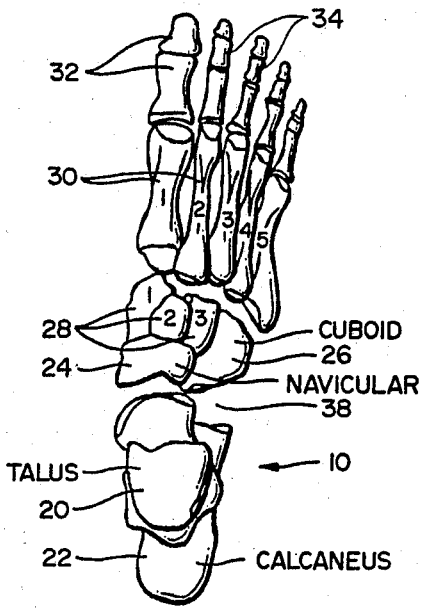
FIG. 1 is a top plan view of the right foot of a human, with certain components of the foot being separated from one another for purposes of illustration.
Figure 2:
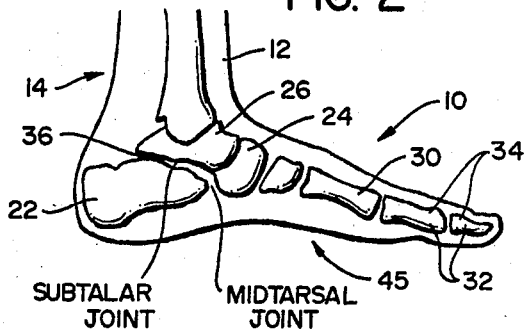
FIG. 2 is a side elevational view looking toward the inside of a person's left foot, and showing certain components of the person's foot.
Figure 3:
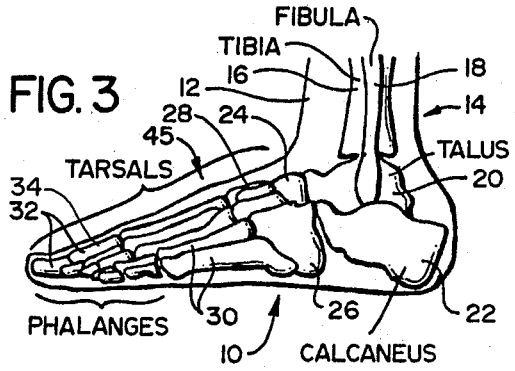
FIG. 3 is a view similar to FIG. 2, but looking toward the outside of the person's foot.

(a) The Main Components or Parts of the Human Leg and Foot and How These Function Relative to One Another With reference to FIGS. 1-3, there is shown a typical human foot 10, and (in FIGS. 2 and 3) the lower part 12 of the leg 14. The two lower bones of the leg 14 are the tibia 16 and the fibula 18. Below the tibia 16 and fibula 18, there is the talus 20 (i.e. the "ankle bone"). Positioned below and rearwardly of the talus 20 is the calcaneus 22 (i.e. the heel bone). Positioned moderately below and forward of the talus 20 are the navicular 24 and the cuboid 26. Extending forwardly from the navicular 24 are the three cuneform bones 28. Extending forwardly from the cuneform bones 28 and from the cuboid 26 are the five metatarsals 30. Forwardly of the metatarsals 30 are the phalanges 32 which make up the five toes 34.

The movement of the talus 20 relative to the tibia 16 and fibula 18 is such that it primarily enables the entire foot to be articulated upwardly and downwardly (in the motion of raising or lowering the forward part of the foot). The talus 20 is connected to the tibia 16 and fibula 18 in such a way that when the entire leg 14 is rotated about its vertical axis (i.e. the axis extending the length of the leg), the talus 20 rotates with the leg 14.

With regard to the relationship of the talus 20 to the calcaneus 22, these move relative to one another about what is called the "subtalar joint" indicated at 36. The subtalar joint 36 can be described generally as a hinge joint about which the talus 20 and calcaneus 22 articulate relative to one another. The hinge axis extends upwardly and forwardly at an angle of about 42° from the horizontal, and also slants forwardly and inwardly at a moderate angle (e.g. about 16° from a straightforward direction).

Figure 4A:
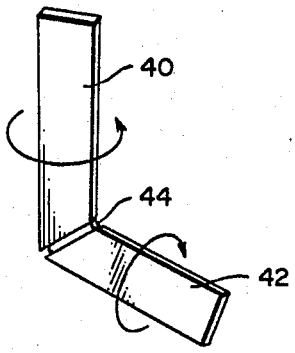
FIGS. 4*a* and 4*b* are perspective views illustrating schematically the rotational movements of the talus and calcaneus about the subtalar joint or in a more gross sense the rotation of the leg on the foot at the subtalar joint.
Figure 4B:
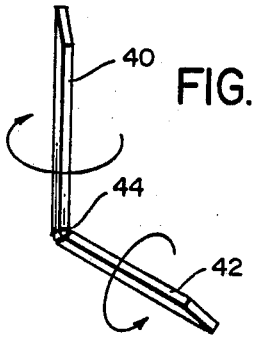

To explain further the hinge motion of the subtalar joint 36, reference is now made to FIGS. 4*a* and 4*b*. The talus 20 and leg can be considered as a vertical board 40, and the calcaneus 22 and the remainder of the foot, but not including the talus, as a horizontally extending board 42, these being hinge connected to one another along a diagonal hinge line 44, with this hinge line corresponding to the subtalar joint 36. It can be seen with reference to FIG. 4*a* that as the talus 20 and leg are rotated inwardly about its vertical axis (i.e. the front part of the leg being rotated toward the center of the person's body), there is a corresponding rotation of the calcaneus 22 and foot (i.e. the horizontal board 42)

about a horizontal axis. These motions are associated with the pronation of the subtalar joint. It can be seen in FIG. 4*b* that an opposite (i.e. outward) rotation of the talus 20 and leg (i.e the vertical board 40) causes a corresponding rotation of the calcaneus 22 and foot (i.e. the horizontal board 42). These motions are associated with the supination of the subtalar joint and are in the opposite direction from that shown in FIG. 4*a*.

This motion described with reference to FIGS. 4*a* and 4*b* above is critical in the gait cycle (i.e. the cycle through which the person goes in normal walking or running motion), and this will be discussed more fully below.

With regard to the midtarsal joint 38, this is in reality composed of two separate joints, the talo-navicular and the calcaneal-cuboid. It is a complex joint, and no attempt will be made to illustrate or recreate its motion accurately. Instead, there will be presented a somewhat simplified explanation of its function as it relates to the present invention.

The main concern, relative to the midtarsal joint, is not the precise relative motion of the parts of the foot that make up this joint, but rather the locking and unlocking mechanism of the midtarsal joint which occurs when there is an outward motion of the leg 14 and the talus 20 (outward motion meaning the rotation of the leg 14 and foot 10 about the vertical axis of the leg 14 in a manner that the knee moves outwardly from the person's body), and an opposite inward motion, respectively. When the leg 14 rotates inwardly so that the subtalar joint pronates, the midtarsal joint 38 unlocks so that the portion of the foot 10 forwardly of the joint 38 (i.e. the midfoot 45) is flexible, this being the "pronated" position of the foot. On the other hand, when the leg 14 and talus 20 rotate outwardly so that the subtalar supinates, the foot is said to be "supinated" so that the midtarsal joint 38 is locked and the midfoot 45 essentially becomes a part of a rigid lever. In actuality, the midfoot 45 never becomes totally rigid, so that even in the totally supinated position, there is some degree of flexibility in the midfoot 45.

Figure 5A:
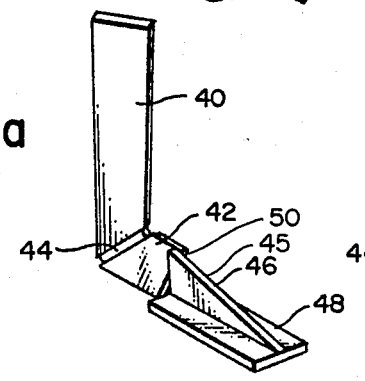
FIGS. 5*a* and 5*b* are schematic views similar to those of FIG. 4*a–b,* but further illustrating the relative movement between the calcaneus and the midfoot about the midtarsal joint.
Figure 5B:
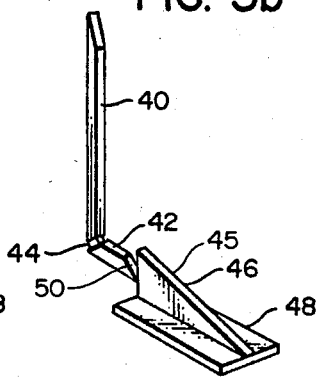

This function of the midtarsal joint will now be explained relative to FIGS. 5*a* and 5*b*. It can be seen that FIGS. 5*a–b* are generally the same as FIGS. 4*a–b*, except that a forward board member 46 is shown to represent the midfoot 45, this member 46 having a downward taper in a forward direction, and also a lower horizontal plate portion 48. This plate portion 48 is intended to represent that the plantar surface (i.e. the lower support surface) of the midfoot 45 engages the underlying support surface in a manner so as to remain generally horizontal to the support surface.

It can be seen that when the two board members 40 and 42 are in the pronated position of FIG. 5*a*, the midtarsal joint represented at 50 in FIGS. 5*a–b* is in a first position which will be presumed to be an unlocked position. In the unlocked position of FIG. 5*a*, the member 46 is not rigid with the horizontal member 42, and the forward member 46 can rotate and/or flex relative to the horizontal member 42. (This is the pronated position of the foot 10.) However, in the position of FIG. 5*b*, the board members 46 and 42 will be presumed to be locked to one another so that the members 42 and 46 form a unitary lever. For ease cf illustration, no attempt has been made to illustrate physically the unlocking relationship of FIG. 5*a* and the locking relationship of FIG. 5*b*. Rather, the illustrations of FIGS. 5*a–b* are to show the relative movement of these components, and the locking and unlocking mechanism is presumed to exist.

(b) The Gate Cycle Which the Person Goes Through in a Normal Walking Motion

Figure 6A:
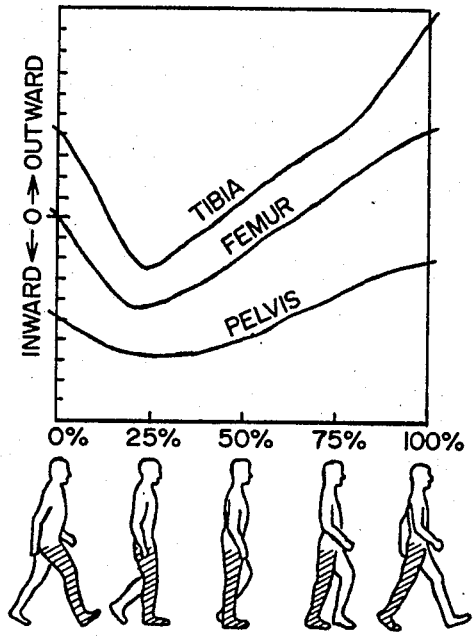
FIG. 6*a* is a graph illustrating the rotational movement of the pelvis, femur and tibia during the gait cycle of the right limb.
Figure 6B:
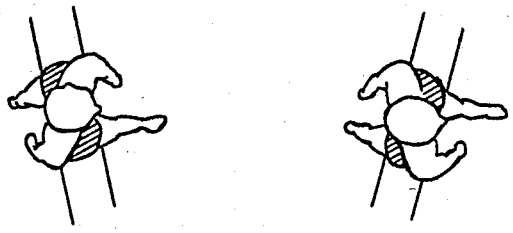
FIG. 6*b* is a top plan view illustrating the rotation of the person's pelvis during that portion of the gait cycle illustrated in FIG. 7*a;*

Reference is first made to FIGS. 6*a* and 6*b*. As illustrated in the graph of FIG. 6*a*, during the normal walking motion, the hip (i.e. the pelvis) moves on a transverse lane, and this movement in the gait cycle is illustrate in FIG. 6*b*. Also, the femur (i.e. the leg bone between the knee joint and the hip) and the tibia rotate about an axis parallel to the length of the person's leg. (It is this rotation of the leg about its vertical axis which in large part causes the pronating and supinating of the foot during the gait cycle, and this will be explained in more detail below.)

There is also the flexing and extension of the knee, as illustrated in the five figures immediately below the graph of FIG. 6*a*. Further, there is the flexing and extension of the ankle joint. At the beginning of the gait cycle, the heel of the forwardly positioned leg strikes the ground, after which the forward part of the foot rotates downwardly into ground engagement. After the leg continues through its walking motion to extend rearwardly during the gait cycle, the person pushes off from the ball of the foot as the other leg comes into ground engagement.

The motions described above are in large part generally apparent to a relatively casual observation of a person walking. However, the motion which is generally overlooked by those not familiar with the gait cycle is the inward and outward rotation of the leg about its lengthwise axis to cause the pronating and supinating of the foot through the gait cycle. This will be described relative to FIG. 7*a* and FIG. 7*b*.

When the leg is swung forwardly and makes initial ground contact, at the moment of ground contact the leg is rotated moderately to the outside (i.e. the knee of the leg is at a more outward position away from the centerline of the body) so that the foot is more toward the supinated position (i.e. closer to the position shown in FIG. 4*b*). However, as the person moves further through the gait cycle toward the 25% position shown in FIG. 7*a*, the leg rotates about its vertical axis in an inside direction so that the subtalar joint is pronating. The effect of this is to rotate the heel of the foot so that the point of pressure or contact moves from an outside rear heel location (shown at 52 in FIG. 7*b*) toward a location indicated at 54 in FIG. 7*b*. This pronating of the subtalar joint 36 produces a degree of relaxation of the midtarsal joint 38 and subsequent relaxation of the other stabilization mechanisms within the arch of the foot. This reduces the potential shock that would otherwise be imparted to both the foot and the lower extremity because the joints of the rearfoot are functioning as torque translators.

Figure 7A:
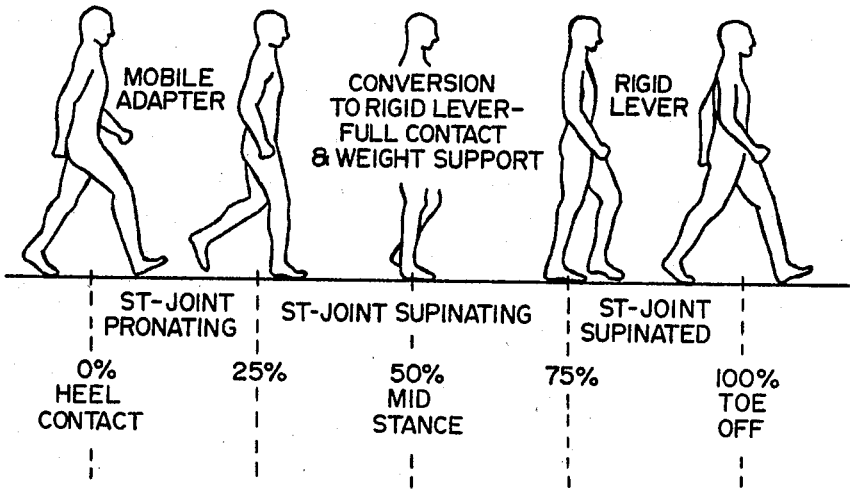
FIG. 7*a* is a graph similar to FIG. 6*a* but illustrating the timing of the pronating and supinating motion of the foot relative to the leg through the gait cycle of the right limb and foot.
Figure 7B:
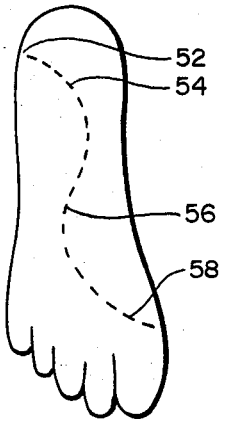
FIG. 7*b* is a view looking upwardly toward the plantar surface of a person's left foot, and illustrating the distribution or location of the center of pressure throughout the period of ground contact of the portion of the gait cycle illustrated in FIGS. 6*a* and 7*a;*

With further movement from the 25% to the 75% position, the leg rotates in an opposite direction (i.e. to the outside) so that the subtalar joint 36 becomes supinated by the 75% location of FIG. 7*a*. This locks the midtarsal joint 38 so that the person is then able to operate his or her foot as a rigid lever so as to raise up onto the ball of the foot in a more stable position and push off as the other leg moves into ground contact at a more forward location.

With reference again to FIG. 7*b*, the initial pressure at ground contact is at 52 and moves laterally across the heel to the location at 54. Thereafter, the pressure center moves rather quickly along the broken line indicated at 56 toward the ball of the foot. As the person pushes off from the ball of the foot and then to some extent from the toes of the foot, the center of pressure moves to the location at 58.

(c) The Intended Function of the Orthotic to Improve Operation of the Person's Foot and Leg Throughout the Gate Cycle If the person's foot were perfectly formed, then there would be no need for an orthotic device. However, the feet of most people deviate from the ideal. Accordingly, the function of the orthotic is first to position the plantar surface of the calcaneus 22 and the midfoot 45 so that the subtalar and midtarsal joints 36 and 38 are initially positioned properly, and to thus control the subsequent motion of the foot parts or components that make up the joints so that the movements of the hip, leg and foot throughout the gait cycle are properly accomplished. It can be readily understood that if the components of the foot have the proper initial position and movement about the subtalar and midtarsal joints 36 and 38, the entire gait cycle, all the way from the coordinated rotation of the hips through the flexing and rotation of the leg, and also through the initial strike of the heel on the ground to the final push off from the toe of the foot, is properly coordinated and balanced for optimum movement.

Since shoes are generally manufactured on a mass production basis, the supporting surface of the interior of the shoe may or may not optimally locate the plantar surface of the foot. Accordingly, it has for many years been a practice to provide an orthotic insert which fits within the shoe to optimize the locations of the foot components. In general, these inserts have been made of various materials, some of which are formed as laminated structures and some as rigid thermoplastic to provide a relatively rigid support for the heel and midfoot regions of the foot.

These orthotics can be formed in a variety of ways. A preferred method of forming an orthotic insert is described in the applicant's U.S. Pat. No. 3,995,002. In that method, there is formed a negative mold or slipper cast from which a positive cast of the plantar surface of the individual's foot is formed. Using this positive cast as a template, an orthotic insert is formed to underlie an area under the foot. The insert itself is fabricated by applying to the positive cast the material which is to orthotic insert. The precise configuration of the insert will depend upon the prescribed corrective measures to be taken for the individual's foot.

(d) The Cycle of movement For Ice Skating

Skating is not an inate method of human locomotion, and it requires both special skill and unique equipment. Nevertheless, it is a weight bearing sport, and it is greatly affected by the stability and performance of the foot. The operating cycle which the person's body goes through in performing the ice skating motion has certain similarities to the gait cycle described above, but there are some important differences. It is believed that the rio art approaches of which the applicant is aware, relative to the design of skate boots and their associated components, have failed to appreciate the significance of these differences.

With regard to the similarities between the support provided by ice skates and conventional shoes, there is substantial similarity when the person is in a standing position. Very little muscular activity is required for balance. Whether the person is in skates or shoes, when the body leans forward, the calf (gastrocnemius) muscles pull the body backwards. Conversely, if the body leans too far backwards, the anterior tibial muscle contracts to pull the body forward. This mechanism keeps the body stable and over the center of gravity.

Like walking, ice skating is characterized by a period of double support and a period of single support. The double support period is the propulsive phase, while the single support period is a gliding phase. Propulsion begins immediately after the non-supporting skate is placed in contact with the ice in proper alignment. At this time, the trailing leg is externally rotated so that the skate faces outwardly (externally) relative to the plane of progression while the hip and knee extend. The primary accelerating force is the explosive extension of the knee. Because the forces generated in the knee reach a peak velocity before the knee is fully extended, the skate is lifted from the ice prior to full extension of the knee. Normally, the ankle joint does not plantarflex (extend) and therefore does not contribute to the propulsion. The propulsive forces generated by the rapid knee extension are transmitted to the ice through the outwardly facing skate.

Figure 8:
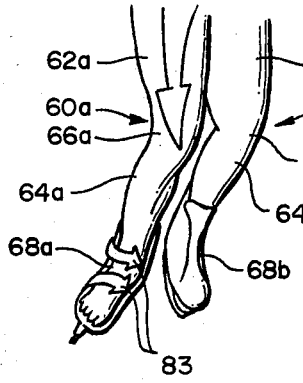
FIG. 8 is a front elevational view of the legs and ice skates of a skater, showing the skater turning to his left and beginning the propulsive phase of the skating cycle, but with the right foot pronating and without use of the present invention.
Figure 9:
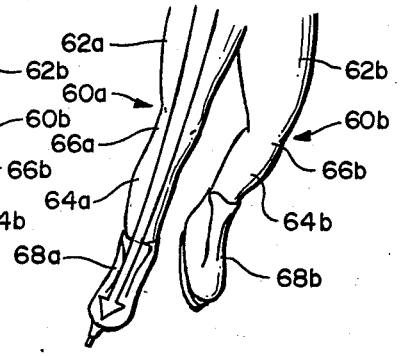
FIG. 9 is a view similar to FIG. 8, illustrating the skater in the same situation as in FIG. 8, but with a pair of skates incorporating the present invention, and with the feet properly positioned.
Figure 10A:
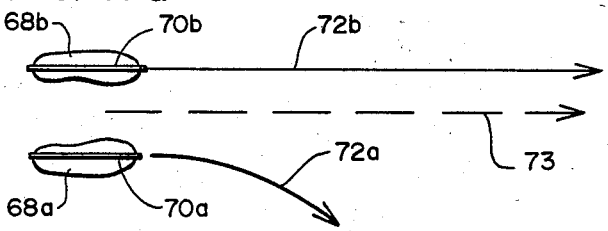
FIG. 10*a* is a schematic top an view illustrating the path of the skates during a portion of the skating cycle.

In FIGS. 8 and 9, there is shown a person's right and left leg **60*a* and 60*b*, respectively, with the legs comprising the thigh 62*a* and 62*b*, the calf 64*a* and 64*b*, and the knee 66*a* and 66*b*, respectively. The right and left boots are designated 68*a* and 68*b*, respectively. In both FIGS. 8 and 9, the skater is turning to his left, with the right leg and skate beginning the propulsive phase, as soon as the left skate 68*b* contacts the ice and commences gliding. FIG. 8 illustrates a situation where the leg and the components of the foot are positioned so that the subtalar joint is pronated and the midtarsal joint is unlocked. In FIG. 9, the right leg 60*a* and the components of the foot are positioned so that the subtalar joint is neutral and the midtarsal joint is locked. The situation of FIG. 8 could occur where the skate boot of the resent invention is not used, and the situation of FIG. 9 would occur under circumstances where the skate boot of the present invention is used. This will be discussed more fully later herein, but first, we will analyze more basic considerations relating to the basic skating motion This motion is illustrated somewhat schematically in FIG. 10*a*. The right boot 68*a* is shown at the completion of the glide portion of the cycle, and is about to move into the propulsive phase. More particularly, the blade 70*a* of the right boot 68*a* is initially aligned substantially straight ahead along the path of motion, and as the right leg 60*a* moves into the propulsive phase, the right leg is rotated so that the blade 70*a* follows a curved path 72*a* slanting further outwardly to the right. As the blade 70*a* moves further into this curved path 72*a*, the skater pushes off from the right leg 60*a* to generate the propulsive force, which is indicated somewhat schematically by the dotted arrow 73** representing the center of gravity of the superimposed torso of the skater.

With regard to the left boot **68*b*, since this is just entering the glide phase, the blade 70*b* is following a path 72*b* which remains substantially straight ahead. When the right leg 60*a* has completed the propulsive phase, then the right leg 60*a* is moved back to a location more directly beneath the person's body and in more straight ahead alignment for this glide phase, with the left leg 60*b*** then beginning its propulsive phase so as to follow a curved outward path.

Figure 10B:
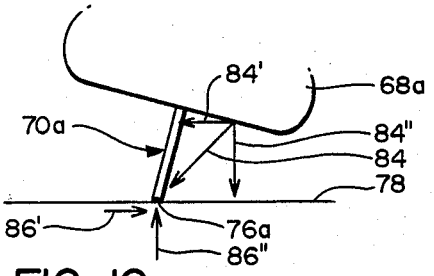
FIG. 10*b* is a schematic view showing a skate boot engaging an ice surface during the propulsion phase, and illustrating a certain application of the force components exerted from the boot to the ice surface.

It is important to consider the manner in which the forces are transmitted from the foot through the boot and through the blade to the ice. Reference is made to FIG. 10*b*, where the right boot 68*a* is shown in its propulsive phase, with the lower edge 76*a* of the blade 70*a* contacting the ice surface 78 at an angle. The thrust forces exerted from the foot are not, during the propulsive phase, spread uniformly across the plantar surface of the foot (i.e. the lower surface). Rather, the thrust forces are transmitted through the medial (inside) of the foot and skate to the supporting surface. The prime mechanism of weight bearing along the medial or "inside" of the foot is the first ray (see FIG. 1), which comprises the first cunieform 28(1), the first metatarsal 30(1) and the great toe 32 (1). Efficient transmission of the accelerating forces and of body weight to the boot and thence to the ice surface can only be accomplished if the bony segment is stable.

Figure 11:
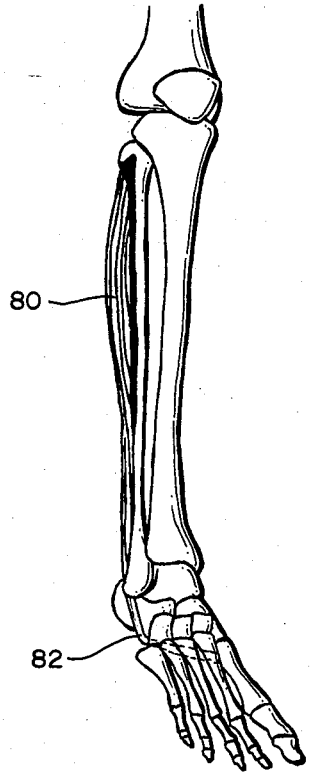
FIG. 11 is an isometric view showing a portion of the person's right leg, and illustrating the Peroneous Longus muscle.
Figure 12:
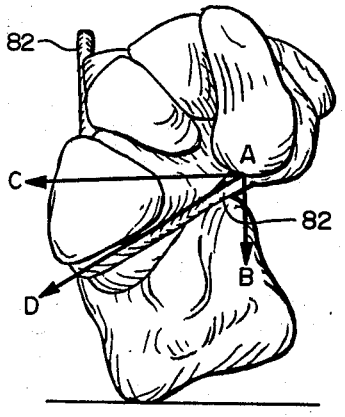
FIG. 12 is a front elevational view of a portion of a person's foot, illustrating the action of the Peroneous Longus tendon where the foot is supinated.
Figure 13:
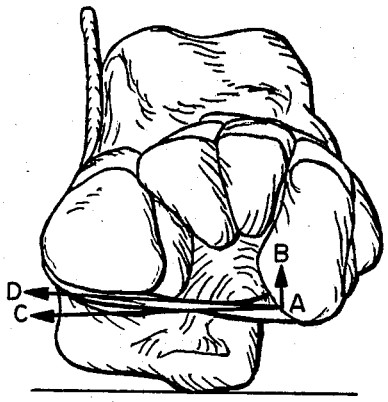
FIG. 13 is a view similar to FIG. 12, illustrating the action of the Peroneous Longus muscle where the foot is pronated.

This stability is dependent upon two factors: a locked (stable) midtarsal joint and contraction of the Peroneus Longus muscle (shown at 80 in FIG. 11). With reference also to FIGS. 12 and 13, the Peroneus Longus tendon 82 extends downwardly along the outside rear portion of the foot, and then beneath the foot in a forward and inward direction to connect to the first ray. When the subtalar joint is supinated or neutral (as shown in FIG. 12), contraction of the Peroneus Longus muscle produces a force indicated at AD, which in turn produces a strong plantar flexion vector of force (indicated at AB).

However, when the subtalar joint is in a pronated position (as in FIG. 13), contraction of the Peroneus Longus muscle produces a force along the first ray in the direction of abduction (arrow AC) but exerts no significant plantar flexion force along the first ray. When the Peroneus Longus muscle is unable to exert an adequate plantar flexion force along the base of the first ray, ground reaction forces directed upwardly against the head of the first metatarsal will create an unstable state of the first ray, and thus degrade the ability of the medial portion of the foot (i.e. the inside of the foot) to transmit from the leg the proper propulsive force into the boot and thence to the blade.

Thus, it becomes apparent that the proper position and internal alignment of the foot are significant factors in the efficiency of skating. Further, it becomes apparent from an examination of FIG. 10 that the ability of the foot to align the underlying blade of the skate boot very accurately, both for the glide phase and the propulsive phase, is critical for properly accomplishing the skating motion.

To explain this further, when the subtalar joint is pronated, the midtarsal joint is unstable and the first ray excessively mobile. To a skater, this translates into a less firm base of support stance, in that the foot remains a mobile adaptor, rather than a rigid lever. In addition, the first ray is excessively mobile and therefore contraction of the Peroneus Longus muscle cannot efficiently stabilize the first ray. This leads to a less efficient forward thrust since this propulsive mechanism is not stable (i.e. excessively mobile), and therefore the generated acceleration forces cannot be effectively transmitted to the ice.

The pronated foot presents an additional complication to skating. Pronation of the rearfoot and unlocking of the midtarsal joint change the internal architecture or alignment of the foot such that there is a relative abduction of the forefoot on the rearfoot. In other words, there is a lateral slaying of the forefoot relative to the rearfoot. This obviously changes the position of the weight bearing areas of the foot relative to the blade axis of the skate, and these internal changes within the foot have traditionally caused foot problems since the shape of the foot has been altered.

Reference is again made to FIGS. 8 and 9. As indicated earlier, in both FIGS. 8 and 9, the skater is turning to his left, with his right leg 60*a* and skate 68*a* about to begin the propulsive phase as soon as the left skate 68*b* contacts the ice and commences gliding. Note that in FIG. 8 the right leg 60*a* is inwardly rotated and the arch has collapsed and rolled toward the midline of the body, as illustrated by the arrows 83. In such an instance, the subtalar joint is pronated and the midtarsal joint unlocked. From this position, there is a decreased efficiency in the propulsion for three distinct reasons:

a. The Peroneus Longus muscle is incapable of stabilizing the first ray, b. The major segments of the suprastructure are not centered over the skate blade, and c. The angle of the blade to the ice is increased (less vertical).

This could occur where the skater is not utilizing the proper orthotic system as described in the present invention.

In FIG. 9, the same skater is shown utilizing the orthotic system of the present system as he rounds the same corner. The right leg 60*a* will begin the propulsive phase as the left skate 68*b* contacts the ice and commences gliding. Note that the right leg 60*a* faces straight forward and the structure of the foot is properly aligned (i.e. the subtalar joint is neutral and the midtarsal joint is locked). From this position, propulsion is more efficient because the Peroneus Longus muscle can stabilize the first ray and hallux for active propulsion. In addition, note that the suprastructure is aligned more directly over the skate blade (optimizing balance and control).

It is also important to note how the force is transmitted from the foot to the lower edge 76*a* of the blade, and to discuss this further, reference is made again to FIG. 10*b*. Since the medial (i.e. inside) portion of the foot is positioned inside of the blade, as the foot moves into the propulsive phase so that the force imparted from the foot is primarily along the first ray, the force is offset (i.e. directed at a location inside of the center of the blade 70*a*).

If the foot is to transmit its propulsive force directly to the underlying ice surface 78, then this force must be directed at the ice engaging blade edge 76*a*. In FIG. 10*b*, the force component exerted by the first ray of the foot is indicated at 84, and it can be seen that this force component 84 is directed to the blade engaging surface 76*a*. For purposes of analysis, this force component can be resolved in two ways. First, with reference to FIG. 10*b*, this force component 84 can be considered as having a horizontal component 84' and a vertical force component 84". This is reacted into the ice along two force components, namely a horizontal force component 86' which is equal and opposite to the force component 84', and the vertical force component 86" which is equal and opposite to the force component 84".

Figure 10C:
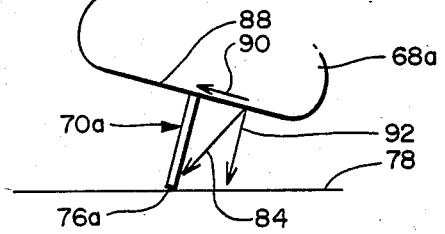
FIG. 10*c* is a view similar to FIG. 10*b* but showing a different resolution of the force components created by the person's foot pushing against the skate boot.

To analyze these force components yet further, in FIG. 10*c*, let us examine the same force component 84 as it relates to the structure of the boot 68*a*. This boot 68*a* has an upwardly facing bearing surface 88 which engages the plantar surface of the person's foot. It will be noted that the force component 84 is directed onto the boot supporting surface 88 at something of an angle slanted from a line perpendicular to the surface 88. Thus, this force component 84 can also be resolved into a first component 90, which is parallel to the surface of the boot 88, and a second component 92 which is perpendicular to the boot supporting surface 88. This indicates that when the skater is pushing off from the first ray of the foot in the propulsive phase, there is not only a downward force component against the boot surface 88, but also the lateral force component 90.

To compare the skating cycle with the normal gate cycle which the person goes through in walking and running, reference is made to FIG. 7. It can be seen that as the right foot makes contact at the 0% location, as described previously, the knee of the leg is slightly outwardly relative to the center line of the body so that the subtalar joint is more toward the supinated position (i.e. closer to the position shown in FIG. 4*b*). As a person's foot moves toward the 25% position shown in FIG. 7*a*, the leg rotates about its vertical axis in an inside direction so that the subtalar joint is pronating. This leaves the front part of the foot somewhat mobile so that it can adjust itself to the ground contour. When the person is at about midstance, the knee is rotating back outwardly so that the subtalar joint is in a neutral phase, where a moderate amount of further outward rotation of the knee will bring the foot to a position where the midtarsal joint is fully locked, as at the 75% position of FIG. 7.

In the skating cycle, the first half of the gate cycle of FIG. 7 is substantially bypassed. Rather, when the skate boot is brought into contact with the ice surface for the gliding phase, the weight of the person is approximately evenly distributed between the forward and rear portions of the foot. This would correspond approximately to the 50% midstance position of FIG. 7. Then when the person's foot goes into the propulsive phase of the skating cycle, the force of the foot is exerted from the person's foot to the boot at the location of the first metatarsal head (i.e. at the ball of the foot just behind the big toe), with some of the force possibly being exerted from the first phalange 32 (i.e. the big toe).

Further, it should be noted that the force exerted by the foot is, as discussed relative to FIGS. 10*b* and 10*c*, exerted not directly downwardly, but also with a laterally outward force component, depending on the angle of the blade to the ice and the stability of the foot within the boot.

Also, as indicated previously, the alignment of the foot relative to the alignment of the skate is, in comparison with the conventional gate cycle in walking and running, more critical.

It is with the foregoing in mind that the skate boot assembly of the present invention was conceived.

(e) Description of the Skate Boot Assembly of the Present Invention

Figure 14:
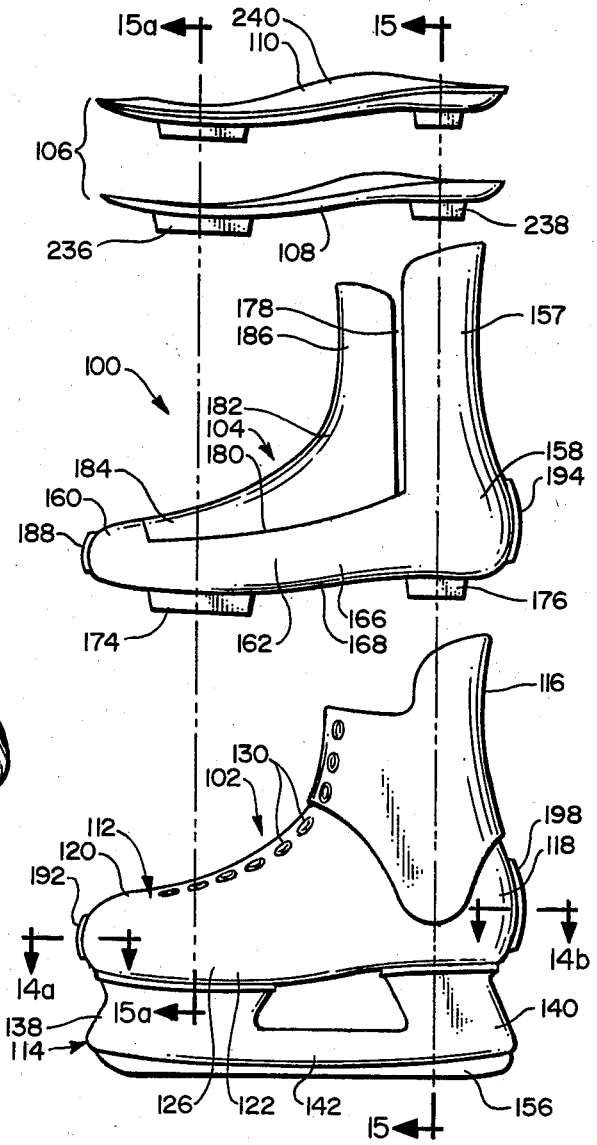
FIG. 14 is an exploded side elevational view showing the main components of the present invention.
Figure 14A:
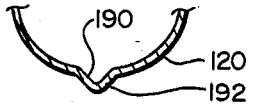
FIG. 14*a* is a sectional view taken along line 14*a*-14*a* of FIG. 14.
Figure 14B:
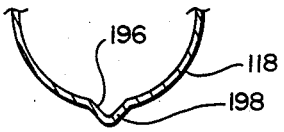
FIG. 14*b* is a sectional view taken along line 14*b*-14*b* of FIG. 14.

The skate boot assembly 100 of the present invention comprises three main components, namely the outer skate boot 102, a flexible bladder 104 which fits within the boot 102, and an orthotic 106 which is placed within the bladder 104 and boot 102. As shown in FIG. 14, the orthotic 106 has two components, namely a lower relatively rigid platform 108, and a padded layer 110 which overlies, and is bonded to the platform 108.

The boot 102 comprises a foot containing boot section 112 and a blade section 114. More particularly, the boot section 112 comprises an upper ankle portion 116, a heel portion 118, a toe portion 120, and a midfoot portion 122 positioned between the heel portion 118 and the toe portion 120. In terms of structure, the boot has inner and outer sidewalls 124 and 126, respectively, and a bottom wall 128. As is customary with skate boots, the upper and forward edge portions of the two sidewalls 124 and 126 are separated at what is called the "lace facings", and these two upper and forward edge portions of the two walls 124 and 126 are formed with eyelets 130 so that the two sidewalls 124 and 126 can be laced together.

The boot section 112 can be made of different materials, but it is commonly made of a molded moderately rigid plastic. Accordingly, the molding process laces some constraints on how the boot can be contoured. More particularly, if it were attempted to form the boot with complex contours, such as inwardly protruding portions, this may complicate the formation of the boot section around the mold and the subsequent withdrawal of the mold from the interior of the boot.

Figure 22:
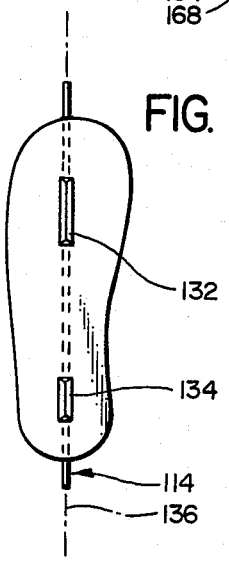
FIG. 22 is a schematic top plan view looking down on the bottom wall of the skate boot and blade.

A quite significant feature of the present invention is the formation of the bottom wall 128 in conjunction with the other components. This bottom wall 128 is formed with a forward and rear downwardly extending V-shaped protrusion 131 and 133, respectively, which in the preferred form are arranged to provide a forward downwardly V-shaped recess 132 and a rear downwardly V-shaped recess 134, respectively. Each recess 132 and 134 has a substantially uniform cross section, with the section being taken at right angles to the longitudinal center axis 136 of the boot assembly 100. (As illustrated in FIG. 22, this longitudinal axis 136 is centered on and parallel with the lengthwise axis of the blade section 114). Further, as illustrated in FIG. 22, the two recesses 132 and 134 each have a center lengthwise axis, and these two axes are centered on the longitudinal axis 136.

The blade section 114 is made of forward and rear mounting sections 138 and 140, joined by an intermediate mounting section 142. The two mounting sections 138 and 140 are quite similar to one another, so only the rear mounting portion 140 is shown in section in FIG. 15. This mounting portion 140 comprises an upper generally horizontal plate 144, joined to a downwardly extending flange 146, by means of two downwardly and inwardly sloping wall sections 148. These two wall sections 148 are dimensioned and contoured so that these define a V-shaped recess 150 to receive in a snugly fitting relationship the rear downwardly extending protrusion 133 of the bottom wall 128. The flange 146 extends from the rear mounting portion 140 through the intermediate section 142 to the forward mounting portion 138 as one continuous member, and it is formed with a downwardly facing slot 154 to receive the skate blade 156.

It is to be understood that the forward mounting portion 138 is constructed similarly to the rear mounting portion 140, in that it provides the same V-shaped recess 150 to receive the forward downwardly protruding portion 131 of the boot bottom wall 128. The blade section 114 is fixedly connected to the bottom wall 128 of the boot section 112 so that the blade section 114 and the boot bottom wall 128 form a substantially rigid, unitary structure.

The bladder 104 has the same overall configuration as that of the boot section 112. More specifically, the bladder comprises an upper ankle portion 157, a heel portion 158, a toe portion 160, and a midfoot portion 162. Further, the bladder comprises short upstanding inner and outer sidewalls 164 and 166, each of which joins to a bottom wall 168. The bottom wall 168 has a pair of forward and rear downwardly extending recesses 17 and 172, respectively, formed by forward and rear downwardly protruding bottom wall bladder sections 174 and 176. These protruding sections 174 and 176 are configured to fit snugly within the two recesses 132 and 134 formed in the skate boot bottom wall 128.

The ankle portion 157 is formed with two vertical slots 178 positioned on the side forward parts of the ankle portion 157, and the lower ends of these slots 178 join to forwardly extending slots 180 that form the top edge of the two sidewalls 164 and 166. The two airs of slots 178 and 180 form a tongue section 182 of the bladder 104. This tongue section 182 comprises a top midfoot portion 184 and an upperly extending ankle tongue portion 186. The edge portions of the bladder 104 that form the slots 178 and 180 are formed with a surface which is at right angles to the adjacent bladder portions, thus diminishing any tendency for the bladder portions to overlap with one another.

It will be noted that the toe portion 160 of the bladder 104 has a forwardly extending locating element 188 which fits in a recess 190 formed by a forwardly protruding portion 192 of the toe portion 120 of the boot section 112. In like manner, the heel portion 158 of the bladder 104 has a rearwardly extending locating element 194 fitting in a related recess 196 of a rearwardly protruding portion 198 of the heel portion 118 of the boot section 114. These locating elements 188 and 194 of the bladder section 104 fit snugly within the respective recesses 190 and 196, in a manner to restrain both vertical and lateral movement of the bladder 104 relative to the boot section 112 at the location of these elements 188 and 194. The function of the rear element 188 in conjunction with the heel recess 190 in the boot section 112 is considered to be particularly significant in the operation of the skate assembly of the present invention.

With regard to the formation of the tongue section 182, the midfoot tongue portion 184 is formed on its upper suface with a middle raised area 200 (See FIGS. 16 and 17) having upstanding side edges 202. The upper edge portions 204 (i.e. the lace facings) of the boot section sidewalls 124 and 126 are arranged so that in their closed position, these edges 204 are in contact with the side edges 202 of the middle raised area 200. Thus, when the boot section 112 is laced up, the wall side edges 204 cooperate with the side edges 202 of the middle raised area 200 to center the tongue midfoot portion 184 in the overall boot assembly 100. It is to be understood that within the broader aspects of the present invention, if the tongue section 182 were made as part of the boot section 112, this same centering effect would be achieved.

Also, the inner surface of the bladder 104 is formed with recessed areas to accommodate certain potions of the foot so that undue pressure is not exerted on these particular foot portions. Thus the bladder has an inside surface to engage said foot with a first range of engagement pressures, with the inside surface having inside relief area means defining at least one relief area surface positioned to be spaced moderately from a surface of the foot so as to provide pressure relief with a second range of engagement less than said first range of engagement pressures. As shown herein, with reference to FIG. 16, there is a relief area 206 at the juncture of the midfoot tongue portion 184 and the upper ankle tongue portion 186. This permits moderate flexing of the person's foot to the ankle, without creating undue pressure on the person's foot at the juncture area of the top part of the foot with the forward part of the ankle. Also, there is a relieved area at 208 on the inner upper forward portion of the bladder 104. Other recessed areas in the bladder 104 will be described later herein.

Figure 19:
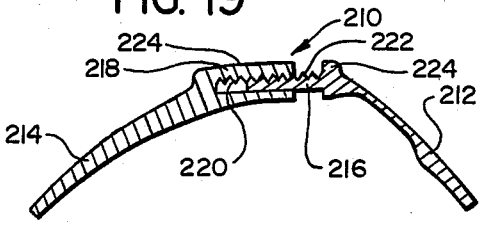
FIGS. 18 and 19 are views similar to FIG. 17, but showing a modified form of the tongue portion of the bladder where the upper middle section can have its width dimension adjusted.
Figure 18:
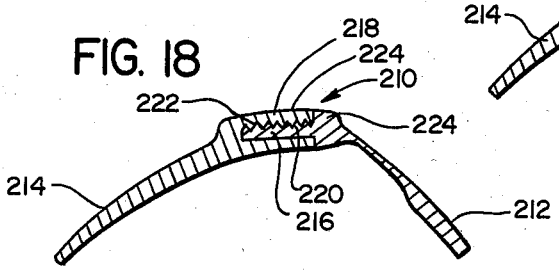

A modification of the top midfoot section is shown in FIGS. 18 and 19. This tongue section is designated 210, and instead of being a unitary tongue section, it is made as inside and outside sections 212 and 214. The joining portions of the sections 212 and 214 are formed as overlapping flap elements 216 and 218. The flap element 218 is formed with downwardly facing fastening surface 220, and the flap 218 has a matching upwardly facing fastening surface 222. These surfaces 220 and 222 could be formed, for example, as Velcro type fasteners. It can readily be seen by examining FIGS. 18 and 19 that by selectively joining the two flap sections 216 and 218 together at different locations, the width dimension of the raised area 224 can be made selectively wider or more narrow. The main benefit of this is that the tongue section can be modified slightly to accommodate various foot configurations.

Figure 20:
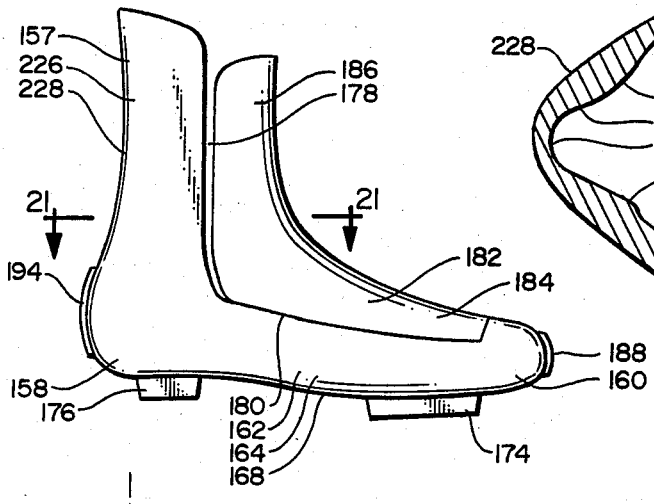
FIG. 20 is a side elevational view of the bladder.
Figure 21:
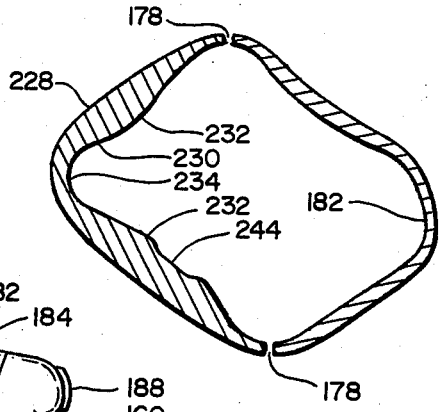
FIG. 21 is a sectional view taken along line 21—21 of FIG. 20.

With reference to FIGS. 20 and 21, the ankle portion 157 of the bladder 104 has a rear ankle portion 226 which cooperates with the upper ankle tongue portion 186 to form the total ankle portion 157. This rear ankle portion has an outer surface 228 generally matching the contour of the adjacent surface of the boot section 112. However, the inner surface 230 of the rear ankle portion 226 is contoured so as to have two inwardly protruding side portions 232. These side portions 232 are positioned so that they form a rear moderately recessed area 234 contoured to fit closely against and receive the lower portion of the Achilles tendon of the person. The inwardly extending side surface portions 232 extend forwardly from the recessed 234 to fit with reasonable snugness against the foot/ankle portion which is immediately above the heel of the person and on opposite sides of the person's Achilles tendon. The net effect is that these inwardly protruding surface portions 232 tend to hold the heel of the person's foot and restrain vertical movement of the person's heel relative to the heel portion 158 of the bladder 104.

To proceed now to a description of the orthotic insert 106, as indicated previously, there is a lower relatively rigid platform 108 and an upper relatively soft padded layer 110 fixedly connected (e.g. by bonding) to the platform 108. The platform 108 has forward and rear downwardly protruding locating elements 236 and 238, and the layer 110 has matching and interfitting elements 236' and 238'. These elements 236, 238, 236' and 238' each have a cross sectional configuration matching that of the forward and rear recesses 170 and 172 of the bladder 104. More specifically' these elements 236, 238, 236' and 238' have in cross sectional configuration a generally "V" shape.

The upper surface 240 of the orthotic 106 is formed with a relatively high friction material so as to avoid slipping between the person's foot and the orthotic 106.

The specific construction of the orthotic 106 can be in accordance with the teachings already known in the prior art. The orthotic 106 should be arranged so that it properly positions the person's foot for initial support engagement where the foot is in the neutral position.

(As indicated previously, this would correspond generally to the optimized foot orientation when the person is at the midstance phase of the conventional gait cycle for walking, as shown in the middle figure of FIG. 7.

Figure 15:
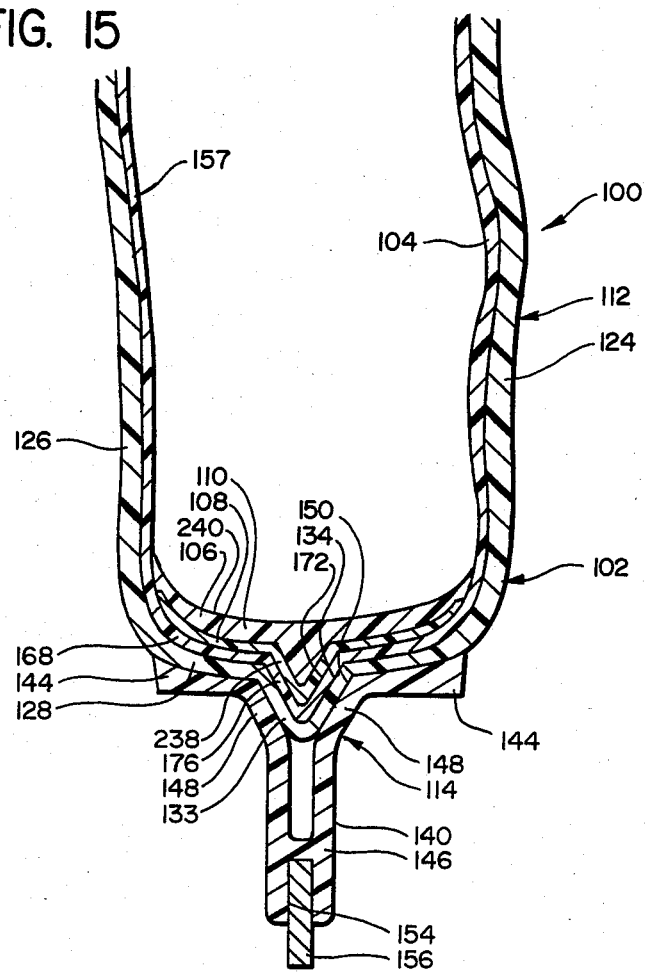
FIG. 15 is a sectional view taken along line 15—15 of FIG. 14, and showing the main components of the present invention assembled as a skate boot assembly.
Figure 15A:
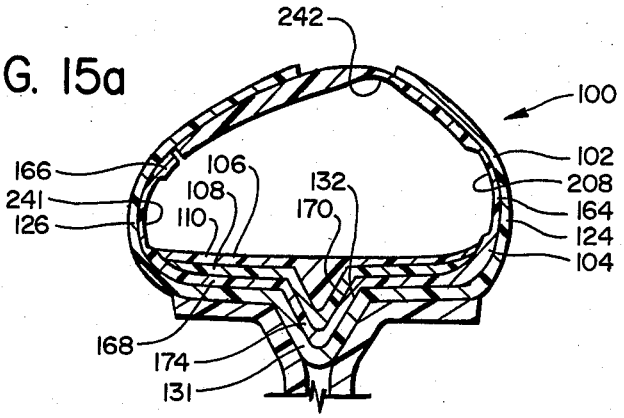
FIG. 15*a* is a sectional view similar to FIG. 15, and taken along line 15*a* of FIG. 14.

To describe the operation of the present invention, first, the three components of the skate boot assembly are positioned as illustrated in FIG. 15. More specifically, the bladder 104 is positioned within the boot section 112, and the orthotic 106 is laced onto the bottom wall 168 of the bladder 104. It will h noted that the two locating elements 236 and 238 of the orthotic 106 fit within the forward and rear recesses 170 and 172 of the bladder 104, and the two protruding elements 174 and 176 that form the recesses 170 and 172 in turn fit snugly within the recesses 132 and 134 formed in the bottom wall 128 of the skate boot section 112. As described previously, the protrusions 131 and 133 of the boot section bottom wall form these recesses 132 and 134 and the entire bottom wall 128 is fixedly connected to the blade section 114 (e.g. by bonding) so that the boot section bottom wall 128 in effect forms with the blade section 114 a unitary structure.

From the above, it can readily be seen that any lateral and/or forward movement of the orthotic 106 relative to the bladder 104, the boot section 112 and blade section 114 is restrained. Further, the orthotic 106 is properly centered with, and properly aligned with each of the bladder 104, the boot section 112 and the blade section 114. Also, it can readily be seen that the bladder 104 itself is properly centered and aligned relative to the boot section 112 and blade section 114.

As indicated previously, the orthotic 106 is formed and contoured so that it receives the person's foot in a manner to properly align the foot relative to the orthotic, and also to orient the midfoot so that the person's midtarsal joint 38 is properly oriented.

With regard to the relationship of the bladder 104 to the boot section 112, as indicated previously, the lower locating elements 174 and 176 of the bladder bottom wall 168 extending into the bottom wall recesses 132 and 134 of the boot section 112 properly position and orient the bladder 104 relative to the boot section 112. Further, the forward and rear locating elements 188 and 194, fitting in the related boot recesses 190 and 196, stabilize the bladder with regard to any possible relative vertical movement between the bladder 104 and the boot section 112. Also, the rear inwardly extending side portions 232 of the rear ankle portion 226 of the bladder 104 snugly engage the person's foot above the heel and on opposite sides of the Achilles tendon so as to restrain any vertical movement of the person's heel relative to the bladder 104.

The tongue section 182 of the bladder 104 is properly centered relative to the boot (and consequently properly centered relative to the person's foot) because of the interaction of the middle raised area 200 with the upper edges 204 of the two boot section sidewalls 124 and 126.

In summary, it can be seen that the person's foot is snugly and securely engaged by the orthotic 106 and the bladder 104. The cooperation of the various locating elements and matching recesses not only orient the orthotic 106, bladder 104 and boot section 112 with another, but relative movement between these components is prevented. With regard to the orientation of the person's foot, we begin by defining the desired orientation of the person's foot relative to the skate blade 156. Then the orthotic 106 is formed to receive the foot in the proper position, and locate this foot relative to the locating elements 236 and 238. Then the orthotic 106 is oriented relative to the bladder 104 and to the boot 102 so that the longitudinal axis defined by the blade 156 is coincident with the desired longitudinal axis of the person's foot.

To relate this to the action of the person's foot in the skating cycle, when the person's foot is brought into the glide phase, it is possible, with the skate assembly 100, to ensure that the person can obtain very accurate alignment of the skate blade 156. Further, the structure of the orthotic 106 is such that the midtarsal joint is positioned so that the person's foot can be properly positioned and locked as the foot goes into the propulsion phase.

Now let us refer back to the manner in which the person's foot reacts against the boot assembly 100. As indicated in FIG. 10*c*, the inner forward portion of the foot exerts a force 84 which is directed not only downwardly, but also laterally during the propulsion phase. This results in the lateral force component 902 which necessarily must b reacted from the orthotic 106 through the bladder 104 and into the skate section bottom wall and blade section 114. With the upper surface 240 of the orthotic 106 being made of a high friction material, lateral movement of the foot relative to the orthotic is resisted. The orthotic in turn imparts the lateral forces through the locating elements 236 and 238 through the adjacent bladder portions into the walls of the downwardly protruding portions 131 and 133 of the skate boot section bottom wall 128. Thus, not only do the related locating elements and recesses properly orient the foot relative to the blade 156 initially, but relative shifting or movement in the longitudinal, transverse and vertical axes is avoided so that the foot always remains in proper orientation with the blade 156.

It was indicated earlier that the bladder 104 was formed with two recessed areas 206 and 208. The purpose of such recesses or grooves is to accommodate important neurovascular structures in order to prevent compression of major nerves and blood vessels of the foot.

With regard to the recess indicated at 208, this is at the inner side of the foot adjacent the first metatarsal phalangial joint. There is another recess 241 located at the outer side of the bladder 104 to accommodate the fifth metatarsal phalangial joint. This recess 241 is located a short distance rearwardly of the aforementioned recess 208.

With regard to the recessed areas 208 and 241 that are formed at the first and fifth metatarsal phalangial joint, the foot may undergo some expansion in those areas, particularly at the first metatarsal phalangial joint. It is not necessary to have pressure on the foot at that particular location. By placing the recesses 208 and 241, this enables the rest of the bladder 104 to conform more closely to the person's foot, and yet provide a certain amount of relief in that particular area.

Another recess 242 is formed in the bladder 104 on the inside surface of the top midfoot portion 140 of the tongue section 182 of the bladder 104. This recess 242 would normally be about two inches long and possibly about one half inch in width, and this is to accommodate and protect the dorsalis pedis artery and vein as well as accommodate the deep peroneal nerve. Yet another recess 244 is formed on the inside surface of the bladder 104 at the location of the lower medial aspect of the ankle area to accommodate and protect the posterior tibial artery, vein and nerve.

Figure 23:
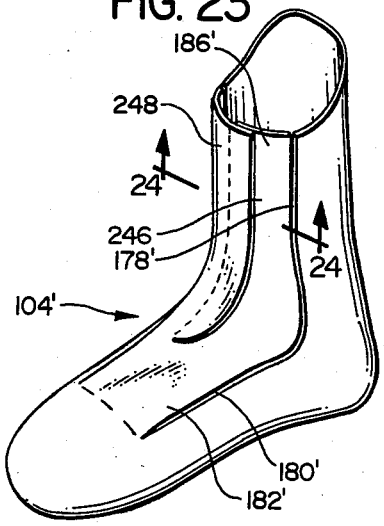
FIG. 23 is an isometric view of a further embodiment of the bladder of the present invention.
Figure 24:
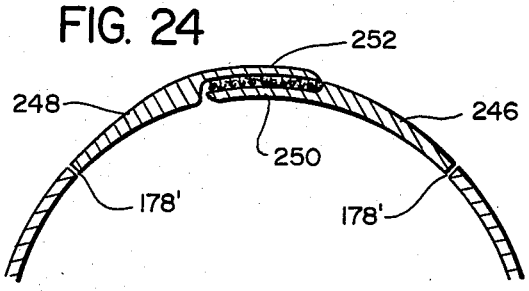
FIG. 24 is a sectional view taken along line 24—24 of FIG. 23, illustrating the adjustable upper portion of the tongue section of the bladder.
Figure 25:
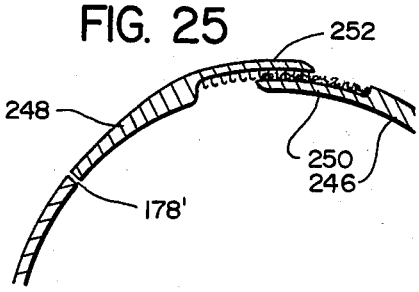
FIG. 25 is a view similar to FIG. 24, showing the tongue components joined to one another and spaced further apart from one another.

A further embodiment of the bladder 104 is shown in FIGS. 23–25. Components of this embodiment shown in FIGS. 23–25 will be given numerical designations corresponding to the earlier disclosed embodiment, with a prime (') suffix distinguishing those of this embodiment. Thus, there is a bladder 104' having slots or separations 178' and 180', these forming a tongue section 182'. The upwardly extending ankle tongue portion 186' is formed in inner and outer sections 246 and 248, with each of these having a related flap 250 and 252, respectively. These flaps 250 and 252 have suitable attaching devices, such as Velcro type fasteners. Thus, the two flaps 250–252 can be joined at different locations, as indicated in FIGS. 24–25.

It is to be understood that these adjustable sections 246–248 can be extended further downwardly and forwardly toward the extreme forward end of the tongue portion 182'.

Figure 26:
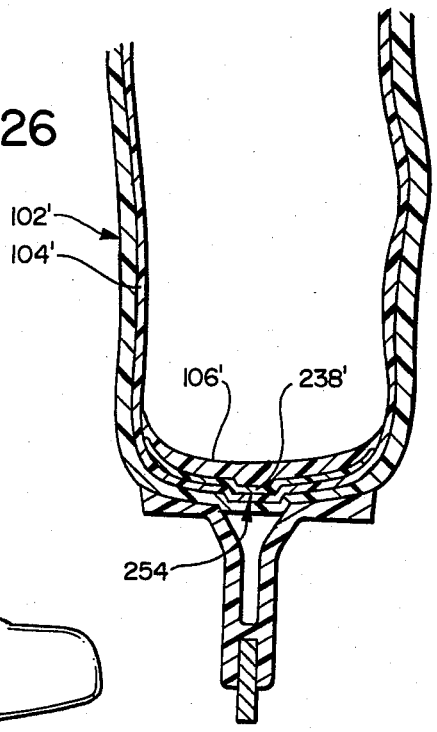
FIG. 26 is a view similar to FIG. 15, but showing a modified form of the present invention.

It also is to be understood that while the various protrusions and matching recesses in the main components have been shown as being elongate and having a V-shaped cross-sectional configuration, these could be made in different shapes. To illustrate this, reference is made to FIG. 26, which shows a modification of the assembly shown in FIG. 15. Components of the skate boot assembly of FIG. 26 will be given numerical designations similar to those shown in FIG. 15, with a prime (') designation distinguishing those of the skate boot assembly of FIG. 26.

Thus, there is a skate boot 102', a bladder 104', and an orthotic insert 106'. The lower protrusion 238' of the orthotic 106' is, however, not made of a V-shaped configuration, but is flattened on the bottom, as indicated by the arrow 254. The corresponding protrusion and recessed portions in the bladder 104' and the boot 102' are similarly shaped. Further, instead of having an elongate configuration, within the broader scope of the present invention, such protrusions and recesses could have a circular configuration, a square configuration, an oblong configuration, etc.

Also, it is to be understood that it would be possible to omit one or more of the matching protrusions and recesses that interlock the main components of the skate boot assembly, or to add additional protrusions and matching recesses. Further, while the forward and ea protruding portions 192 and 198 of the boot member that form the forward and rear recesses of the boot member are shown as extending outwardly from the surface of the boot, it is to be understood that these recess forming protrusions could simply be formed in the thickness of the boot, without actually extending beyond the outer surface of the boot. This could be done for aesthetic reasons.

Figure 27:
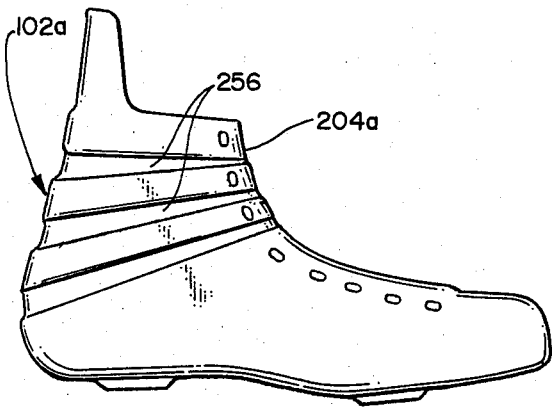
FIG. 27 is a side elevational view of a second embodiment of the boot portion of the present invention

It is also to be recognized that the skate boot 102 could be modified in various ways. For example, as shown in FIG. 27, there is shown a skate boot **102*a* having the upper ankle portion 116*a* formed with horizontally extending grooves 256 that extend from around the rear portion of the ankle of the boot 102*a* toward the forward lace facings 204*a*. These grooves 256 permit flexing of the ankle portion of the boot 102** along a horizontal transverse axis, thus permitting a certain amount of upward and downward movement of the forward art of the foot relative to the calf of the leg.

Figure 28:
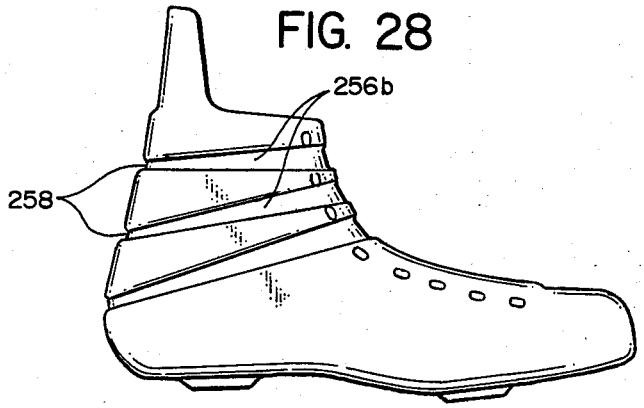
FIG. 28 is a view similar to FIG. 27, showing a third embodiment of the boot portion of the present invention.

As shown in FIG. 27, these recesses or grooves 256 are larger at the rear ankle portion of the boot **102*a*, and narrower at the forward portion of the ankle portion 116*a* of the boot 102*a*. However, as shown in FIG. 28, these grooves 256*b* can be shaped so that the rear portions 258 of such grooves 256*b* have a relatively smaller width dimension, while the forward portion of the grooves 256** have a greater width dimension.

Figure 29:
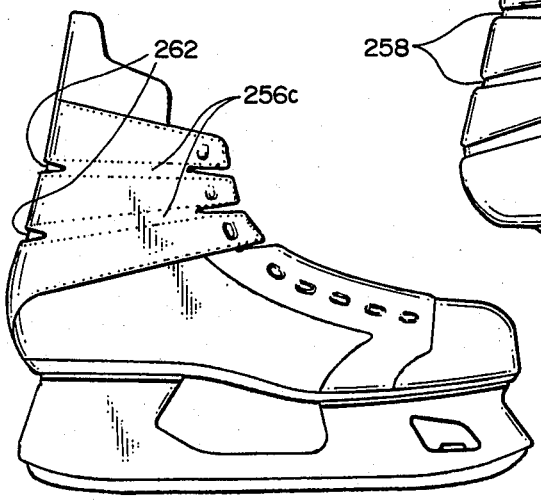
FIG. 29 is a side elevational view similar to FIGS. 27 and 28 showing yet a fourth embodiment of the boot portion of the present invention.

As a further modification, reference is made to FIG. 29, where there are shown such grooves at **256*c*. Instead of being formed as grooves with a flap bottom wall portion, the grooves 256*c* have a V-shaped cross-sectional configuration, as illustrated at 262 in FIG. 29**.

The various configurations of these grooves, 256, **256*b* and 256*c* are to obtain certain desired characteristics in the flexing action of the ankle portion of the boot 102**.

With regard to the formation of the orthotic 106, it is to be understood that this could be a custom fit orthotic, or an orthotic which could be mass produced. In the event that it is a custom fit orthotic, then the custom fitting could be accomplished in various ways. For example, the lower rigid part 108 could have a fixed configuration, while the upper portion 110 could be made of a cork-like material or the like which softens when heated. Then the heated orthotic could be pressed against the person's foot to obtain the proper contour in an appropriate fitting operation. Alternatively, both orthotic portions 108 and 110 could be made of a material which yields at raised temperatures and both be custom contoured to the person's foot.

With regard to the bladder 104, this could be made as a custom fit bladder. However, one of the benefits of the present invention is that with the bladder being made of a moderately yielding material, it could more easily be mass produced and yet comfortably fit the person's foot under most circumstances. Also, it should be understood that within the broader aspects of the present invention, the bladder 104 could be made of a material where there are different densities. For example, the bottom wall portion 168 could be made of a material of the greatest density, so that it would be relatively stiff and strong. The side walls 164 and 166 could be made of an intermediate density, while the upper ankle portions and tongue portion 182 could be made of a material of the least density and thus be relatively soft.

Figure 16:
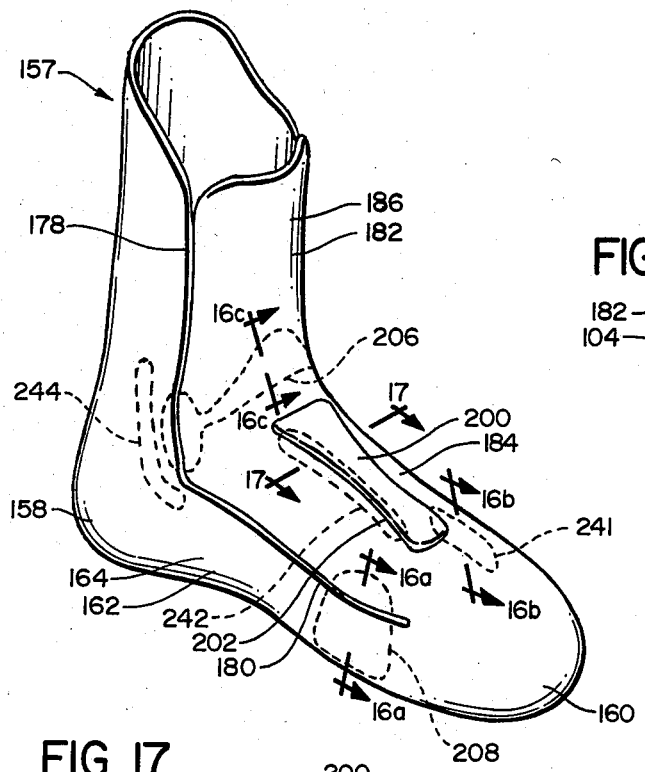
FIG. 16 is an isometric view of a first embodiment of the bladder of the present invention.
Figure 16A:
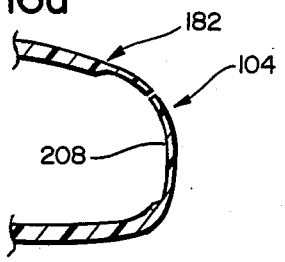
FIGS. 16*a*, 16*b* and 16*c* are sectional views taken along line 16*a*—16*a*, 16*b*—16*b* and 16*c*—16*c* of FIG. 15.
Figure 16B:
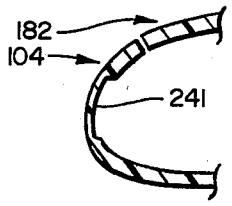
Figure 16C:
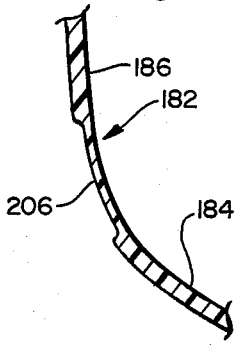
Figure 17:
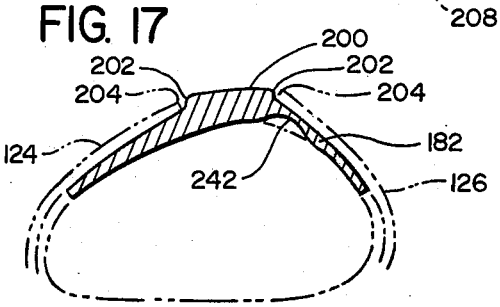
FIG. 17 is a sectional view of the tongue section of the bladder shown in FIG. 16, taken along line 17—17.

Also, it should be noted that for ease of illustrations, the protrusions 170, 172, 188 and 194 have not been shown in the drawings of the bladders 104 and 104' presented in FIGS. 16 and 23, respectively.

It is also to be understood that within the broader aspects of the present invention, while the three main components (i.e. the skate boot 102, the bladder 104 and the orthotic 106) are desirably made of three separate components, these could conceivably be formed or joined in some unitary structure in different combinations. For example, it is conceivable that the orthotic 106 could be made integrally with the bladder 104. Another possibility is that the bladder 104 could be structurally joined to the skate boot 102. However, a discussion of the manufacturing processes and structures by which this might be accomplished is beyond the scope of the present disclosure, which discloses the presently preferred embodiment.

It is to be understood that while the present invention has been described with reference specifically to a skate boot assembly, the principles of the present invention could be incorporated in other boot assemblies (e.g. a ski boot, a climbing boot, a hiking boot or possibly other boot assemblies) where similar or related problems and objectives may be encountered.

Figure 30:
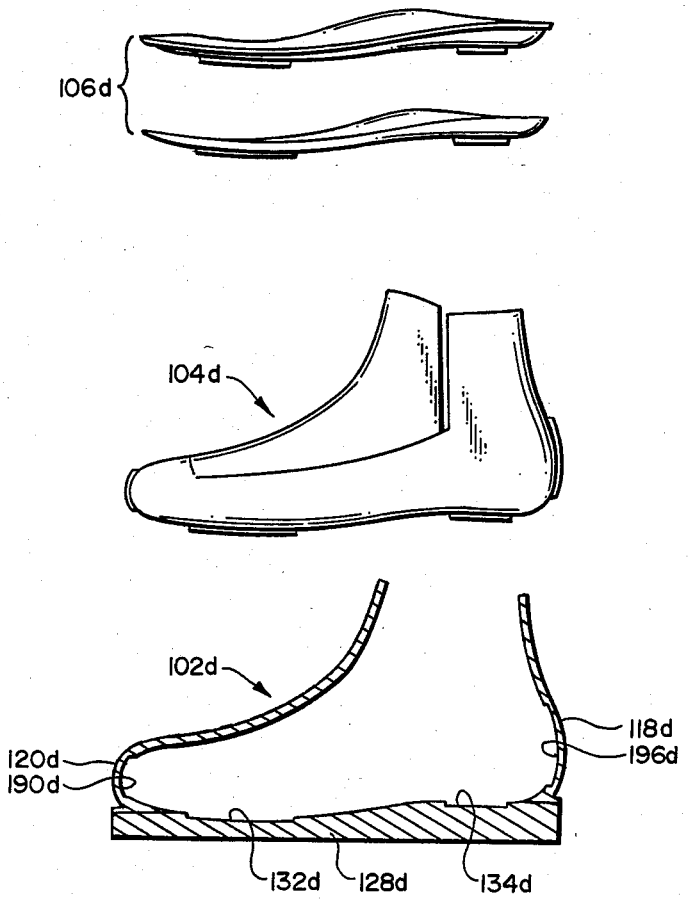
FIG. 30 is an exploded side elevational view, similar to FIG. 14, but showing the present invention incorporated in the boot assembly other than a skate boot assembly, and also showing the boot member in section.

FIG. 30 shows the present invention incorporated in a hiking boot assembly. Components of this embodiment will be given numerical designations corresponding to previous embodiments, with a "d" suffix distinguishing those of the present embodiment.

There is an orthotic insert **106*d* and a bladder 104*d* which are made as previously described herein. However, the boot member 102*d* has a sole portion 128*d* which is constructed to directly engage a ground surface. The forward and rear recesses 132*d* and 134*d* are formed within the thickness of the sole portion 128*d* of the boot member 102*d*. Further, the forward and rear recesses 190*d* and 196*d*, respectively, are formed in thickened portions of the toe and heel sections 120*d* and 118*d* of the boot member 102*d*. It is believed that the mode of operation of the embodiment of FIG. 30** should be readily understandable in light of the description of the earlier embodiments.

It is also to be understood that various modifications and changes could be made to the specific embodiments shown herein, without departing from the broader aspects of the present invention.

I claim:

1. A skate boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a blade which has a lengthwise blade axis being aligned with, and centered on, said longitudinal center axis of the assembly;

c. a bladder adapted to be removably positioned in said boot cavity and made at least in part of a moderately yielding material, said bladder comprising a sole portion, and side and heel portions extending upwardly from the sole portion of the bladder;

d. an orthotic insert having a longitudinal alignment axis and adapted to be removably positioned in the foot receiving cavity of the boot adjacent the sole portion of the bladder, said insert having an upwardly facing surface contoured to position a plantar surface of a foot, in a manner to align the foot with the longitudinal alignment axis of the insert;

e. said assembly being arranged with first interfitting protrusion and recess means which is arranged in a manner that with a person's foot being positioned in said boot assembly, said first interfitting and protrusion and recess means is positioned to restrain at least said orthotic insert relative to the sole portion of the boot member with regard to movement in a horizontal plane, and to align the longitudinal alignment axis of the insert with the longitudinal center axis of the boot assembly, said protrusion and recess means being further arranged in a manner that without the person's foot being positioned in the boot assembly the protrusion and recess means are positioned to permit the bladder an the insert to be removed from the boot assembly;

whereby with the foot located in the boot assembly, the foot is positioned by the insert in a manner to support, center and align the foot with the longitudinal axis of the boot assembly, to insure proper centering with, alignment with, and support from the skate blade.

2. The assembly as recited in claim 1, wherein the heel portion of the bladder has inwardly extending ankle engaging means to engage a rear ankle portion of a person's foot above a heel portion of the foot and laterally adjacent an Achilles tendon of an ankle/heel portion of the foot.

3. The assembly as recited in claim 2, wherein said inwardly extending ankle engaging means is arranged to engage the rear ankle portion on opposite sides of the Achilles tendon.

4. The assembly as recited in either claim 2 or 3, wherein said bladder and said boot member are provided with a second interfitting protrusion and recess means, said second interfitting protrusion and recess means being arranged to restrain upward movement of the heel portion of the bladder relative to the boot member.

5. The assembly as recited in claim 1, wherein a toe portion of said bladder and the toe portion of the boot member have second interfitting protrusion and recess means to restrain relative movement between the toe portion of the bladder and the toe portion of the boot member.

6. The assembly as recited in claim 1, wherein said first protrusion and recess means is characterized in that the sole portion of the boot member is provided with recess means, and the insert is provided with downwardly extending protrusion means interfitting with the recess means of the sole portion of the boot member.

7. The assembly as recited in claim 6, wherein the protrusion means of the insert comprises at least a forward protrusion portion and a rear protrusion portion, and the recess means of the boot member comprises at least a forward recess portion and a rear recess portion interfitting with the forward and rear protrusion portions of the inserts.

8. The assembly as recited in claim 1, wherein said first protrusion and recess means is characterized in that said insert is provided with protrusion means interfitting with recess means in the sole portion of the bladder, and the bladder is provided with protrusion means interfitting with recess means formed in the sole portion of the foot member, whereby the protrusion means of the insert and the bladder interfit with the recess means of the sole portion of the boot member so as to restrain relative movement between the insert, the bladder and the boot member in said horizontal plane.

9. The assembly as recited in claim 1, wherein said bladder has a tongue section positioned to extend over at least an upper midfoot portion of the foot, said main boot member having two side walls having upper edge portions, said tongue section having an upwardly raised middle tongue portion adapted to engage the upper edge portions of the two boot side walls, whereby the tongue section can be centered relative to the main boot member.

10. The assembly as recited in claim 9, wherein said tongue has an upper portion which is arranged to extend over a forward ankle portion of the foot, and the raised middle tongue portion extends upwardly along the upper portion of the tongue.

11. The assembly as recited in claim 1, wherein said bladder has a tongue section positioned to extend adjacent to a forward ankle portion of the foot, and said tongue section has a raised middle portion adapted to engage edges of two side walls of the main boot member, whereby said tongue section can be centered relative to the main boot member.

12. The assembly as recited in claim 1, wherein said bladder is formed with a tongue section having a midfoot tongue portion positioned to be adjacent an upper midfoot portion of the foot and an upper ankle tongue portion adapted to be positioned adjacent to and forwardly of an ankle portion of the foot, said bladder having an inside relief area at a location at a juncture of the midfoot tongue portion and the upper ankle tongue portion, thus permitting moderate flexing of the person's foot, without creating undue localized pressure.

13. The assembly as recited in claim 1, wherein said bladder is formed with an inside relief area positioned to be located adjacent an inner side portion of the foot adjacent a first metatarsal phalangial joint.

14. The assembly as recited in claim 1, wherein said bladder is provided with an inside relief area located at an outer forward side portion of the bladder positioned to be adjacent a fifth metatarsal phalangial joint of the ,

15. The assembly as recited in claim 1, wherein the bladder has an inside relief area at an inside surface of a top midfoot portion of the bladder, said relief area being positioned to be adjacent a dorsalis pedis artery and vein of the foot.

16. The assembly as recited in claim 1, wherein said bladder is formed with an inside relief area at a rear inner portion of the bladder, said relief area being positioned so as to be adjacent a posterior tibial artery of the foot.

17. The assembly as recited in claim 1 wherein said bladder is formed with the following:

a. a first inside relief area positioned to be located adjacent an inner side portion of the foot adjacent a first metatarsal phalangial joint;

b. a second inside relief area located at an positioned to be adjacent a fifth metatarsal phalangial joint of the foot;

c. a third inside relief area at an inside surface of a top midfoot portion of the bladder, said relief area being positioned to be adjacent a dorsalis pedis artery and vein of the foot;

d. a fourth inside relief area at a rear inner portion of the bladder, said relief area being positioned so as to be adjacent a posterior tibial artery of the foot.

18. The assembly as recited in claim 1, wherein said bladder is formed with a tongue section said tongue section being formed with right and left tongue portions which are formed with an adjustable connecting means, permitting said right and left tongue portions to be joined at a location further from each other or a location closer to each other.

19. The assembly as recited in claim 18, wherein the connecting means of said two tongue portions are formed : , as flap portions adapted to overlie one another, with said flap portions being formed with connecting surface portion.

20. The assembly as recited in claim 19, wherein the two flap portions of the tongue portions are formed with an upwardly raised area, positioned to engage upper edge portions of two side walls of the boot member, said tongue section can be centrally positioned relative to said main boot member.

21. The assembly as recited in claim 18, wherein said tongue portions are formed with a middle raised portion adjacent the connecting means of the two tongue portions, said raised portion being positioned to engage upper edge portions of side walls of the main boot member, whereby said tongue section can be centered relative to said main boot member.

22. The assembly as recited in claim 1, wherein said main boot member has an ankle section comprising a rear boot ankle portion and side boot ankle portions, said ankle section being formed with generally horizontally extending groove means extending from the rear boot ankle portion around the side boot ankle portions.

23. The assembly as recited in claim 22, wherein said groove means is characterized in that there is a plurality of grooves extending from the rear boot ankle portion around the side boot ankle portions.

24. The assembly as recited in claim 23, wherein said grooves have a vertical width dimension, with the width dimension of the grooves being greater at a rear location and less at a forward location of the grooves.

25. The assembly as recited in claim 23, wherein said grooves have a vertical width dimension, with the width dimension being less at a rear location of the grooves and greater at a forward location of the grooves.

26. The assembly as recited in claim 23, wherein at least some of said grooves have a cross-sectional configuration transverse to the lengthwise axis of the groove of a V-shape.

27. A boot assembly having a longitudinal center axis, a transverse axis, and a vertical axis, said assembly comprising:

a. a main boot member defining a foot receiving cavity and comprising a lower sole portion, a toe portion, a heel portion, and two side portions;

b. an orthotic insert having a longitudinal alignment axis and adapted to be removably positioned in the foot receiving cavity of the boot above the lower sole portion, said insert having an upwardly facing surface contoured to engage a plantar surface of a foot, in a manner to align the foot with the longitudinal alignment axis of the insert;

c. said main boot member and said insert being arranged with interfitting protrusion and recess means which is arranged in a manner that with a person's foot being positioned in the assembly, said protrusion and recess means is positioned to restrain said orthotic insert relative to the sole portion of the boot member with regard to transverse movement in a horizontal plane, and to align the longitudinal alignment axis of the insert with the longitudinal center axis of the boot assembly, said protrusion and recess means being further arranged in a manner that without the person's foot being positioned in the boot assembly the protrusion and recess means is positioned to permit the insert to be removed from the boot assembly.

28. The assembly as recited in claim 27, wherein the protrusion and recess means is characterized in that the sole portion of the boot member is provided with recess means, and the insert is provided with downwardly extending protrusion means interfitting with the recess means of the sole portion of the boot member.

29. The assembly as recited in claim 28, wherein the protrusion means of the insert comprises at least a forward protrusion portion and a rear protrusion portion, and the recess means of the boot member comprises at least a forward recess portion and a rear portion interfitting with the forward and ear protrusion portions of the insert.

30. The assembly as recited in claim 29, wherein the forward protrusion portion and forward recess potion are located forwardly of a midfoot location of the boot member, and the rear protrusion portion and rear recess portion are located adjacent a heel location of the boot member.

31. A bladder adapted to be removably positioned in a foot receiving cavity of a boot member, said bladder being made at least in part of a moderately yielding material, said bladder comprising a sole portion, and side and heel portions extending upwardly from the sole portion of the bladder, the heel portion of the bladder having inwardly extending ankle means to engage a rear angle portion of a person's foot above a heel portion of the foot and on opposite sides of an Achilles tendon of an ankle/heel portion of the foot, said bladder being arranged with a portion of interfitting protrusion an recess means adapted to engage a matching portion of said protrusion and recess means of said boot member in a manner that with a person's foot in the bladder and boot member, the protrusion and recess means restrains upward movement of the bladder relative to the boot, and with the foot removed form the bladder and boot member, the bladder can be freely removed from the boot member.

32. A bladder adapted to be positioned in a foot receiving cavity of a boot member, said bladder comprising a sole portion, and side and heel portions extending upwardly from the sole portion of the bladder, said bladder having an inside surface to engage said foot with a first range of engagement pressures, said inside surface having inside relief area means defining at least one relief area surface positioned to be spaced moderately from a surface of the foot so as to provide pressure relief with a second range of engagement pressure less than said first range of engagement pressures to a person's foot at said relief area, said bladder being formed with a substantially unitary tongue section having a midfoot tongue portion positioned to be adjacent an upper midfoot portion of the foot and an upper ankle tongue portion adapted to be positioned adjacent to and forwardly of an ankle portion of the foot, said relief area means comprising an inside relief area having a wall portion adjoining and positioning said midfoot tongue portion and said ankle tongue portion relative to one another at a location at a juncture of the midfoot tongue portion and the upper ankle tongue portion, thus permitting moderate flexing of the person's foot, while locating said midfoot tongue portion and said ankle tongue portion relative to one another without creating undue localized pressure.

33. A bladder adapted to be positioned in a foot receiving cavity of a boot member, said bladder comprising a sole portion, and side and heel portions extending upwardly from the sole portion of the bladder, said bladder having an inside surface to engage said foot with a first range of engagement pressures, said inside surface having inside relief area means defining at least one relief area surface positioned to be spaced moderately from a surface of the foot so as to provide pressure relief with a second range of engagement pressures less than said first range of engagement pressures to a person's foot at said relief area, said relief area means being positioned to be located adjacent an inner side portion of the foot adjacent a first metatarsal phalangial joint.

34. A bladder adapted to be positioned in a foot receiving cavity of a boot member, said bladder comprising a sole portion, an side and heel portions extending upwardly form the sole portion of the bladder, said bladder having an inside surface to engage said foot with a first range of engagement pressures, said inside surface having inside relief area means defining at least one relief area surface positioned to be spaced moderately from ma surface of the foot so as to provide pressure relief with a second range of engagement pressures less than said first range of engagement presures to a person's foot at said relief area, said relief area means being located at an outer forward side portion of the bladder positioned to be adjacent a fifth metatarsal phalangial joint of the foot.

35. A bladder adapted to be positioned in a foot receiving cavity of a boot member, said bladder comprising a sole portion, and side and heel portions extending upwardly from the sole portion of the bladder, said bladder having an inside surface to engage said foot with a first range of engagement pressures, said inside surface having inside relief area means defining at least one relief area surface positioned to be spaced moderately from a surface of the foot so as to provide pressure relief with a second range of engagement pressures less than said first range of engagement presures to a person's foot at said relief area, said relief area means being positioned at an inside surface of a top midfoot portion of the bladder, said recess means being positioned so as to be adjacent a dorsalis pedis artery and vein of the foot.

36. A bladder adapted to be positioned in a foot receiving cavity of a boot member, said bladder comprising a sole portion, and side and heel portions extending upwardly from the sole portion of the bladder, said bladder having an inside surface to engage said foot with a first range of engagement pressures, said inside surface having inside relief area means defining at least one relief area surface positioned to be spaced moderately from a surface of the foot so as to provide pressure relief with a second range of engagement pressures less than said first range of engagement presures to a person's foot at said relief area, said relief area means being formed at a rear inner portion of the bladder, said relief area means being positioned so as to be adjacent a posterior tibial artery of foot.

37. A boot assembly comprising:

a. a main boot member defining afoot receiving cavity and comprising a lower sole portion and two side portions, said two side portions, said two side portions comprising side walls having upper edge portions;

b. a tongue section having an upwardly raised middle tongue portion adapted to engage the upper edge portions of the two boot side portions, whereby the tongue section can be centered relative to the boot member;

c. said tongue section being formed with right and left tongue portions which are formed with an adjustable connecting means, permitting said right and left tongue portions to be joined at a location further from each other or a location closer to each other.

38. The assembly as recited in claim 37, wherein said tongue has an upper portion which is arranged to extend over a forward ankle portion of the foot, and the raised middle tongue portion extends upwardly along the upper portion of the tongue.

39. The assembly as recited in claim 37, wherein said tongue section extends from a toe portion of the boot member.

40. The assembly as recited in claim 37, wherein the connecting means of the two tongue portions are formed as flap portions adapted to overlie one another, with said flap portions being formed with connecting surface portions.

41. A boot assembly comprising:

a. a main boot member defining a foot receiving cavity and comprising a lower sole portion, a toe portion, a heel portion, and two side portions;

b. a tongue section positioned to extend rearwardly from a toe portion of a boot member, said tongue section being formed with right and left tongue portions which are formed with an adjustable connecting means, permitting said right and left tongue portions to be joined at a location further from each other or a location closer to each other.

42. The assembly as recited in claim 41, wherein the connecting means of the two tongue portions are formed as flap portions adapted to overlie one another, with said flap portions being formed with connecting surface portions.

43. The assembly as recited in claim 42, wherein the two flap portions of the tongue potions are formed With an upwardly raised area, positioned to engage upper edge portions of two side walls of the boot member, whereby said tongue section can be centrally positioned relative to the main boot member.

44. The assembly as recited in claim 41, wherein said tongue portions are formed with a middle raised portion adjacent the connecting means of the two tongue portions, said raised portion being positioned to engage upper edge portions of side walls of the main boot member, whereby said tongue section can be centered relative to said main boot member.

45. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder adapted to be positioned in said boot cavity and made at least in part of a moderately yielding material, said bladder comprising a sole portion, and side and heel portions extending upwardly from the sole portion of the bladder;

c. an orthotic insert having a longitudinal alignment axis and adapted to be positioned in the foot receiving cavity of the boot above the sole portion of the bladder, said insert having an upwardly facing surface contoured to engage a plantar surface of a foot, in a manner to align the foot with the longitudinal alignment axis of the insert;

d. said assembly being arranged with first interfitting protrusion and recess means which is arranged in a manner that with a person's foot being positioned in said boot assembly, said first interfitting and protrusion and recess means is positioned to restrain at least said orthotic insert relative to the sole portion of the boot member with regard to movement in a horizontal plane, and to align the longitudinal alignment axis of the insert with the longitudinal center axis of the boot assembly said protrusion and recess means being further arranged in a manner that without the person's foot being positioned in the boot assembly the protrusion and recess means are positioned to permit the bladder and the insert to be removed from the boot assembly, whereby with the foot located in the boot assembly, the foot is engaged by the insert in a manner to support, center and align the foot with the longitudinal axis of the boot assembly.

46. The assembly as recited in claim 45, wherein the heel portion of the bladder has inwardly extending ankle engaging means to engage a rear ankle portion of a person's foot above a heel portion of the foot and on opposite sides of an Achilles tendon of an ankle/heel portion of the foot.

47. The assembly as recited in claim 45, wherein said bladder and said boot member are provided with a second interfitting protrusion and recess means, said second interfitting protrusion and recess means being arranged to restrain upward movement of the he of the bladder relative to the boot member.

48. The assembly as recited in claim 45, wherein said bladder and said boot member are provided with a second interfitting protrusion and recess means, said second interfitting protrusion and recess means being arranged to restrain upward movement of the heel portion of the bladder relative to the boot member.

49. The assembly as recited in claim 45, wherein a toe portion of said bladder and the toe portion of the boot member have second interfitting protrusion and recess means to restrain relative movement between the toe portion of the bladder and the toe portion of the boot member.

50. The assembly as recited in claim 45, wherein said first protrusion and recess means is characterized in that the sole portion of the boot member is provided with recess means, and the insert is provided with downwardly extending protrusion means interfitting with the recess means of the sole portion of the boot member.

51. The assembly as recited in claim 50, wherein the protrusion means of the insert comprises at least a forward protrusion portion and a rear protrusion portion, and the recess means of the boot member comprises at least a forward recess portion and a rear recess portion interfitting with the forward and rear protrusion portions of the inserts.

52. The assembly as recited in claim 45, said first protrusion and recess means is characterized in that said insert is provided with protrusion means interfitting with recess means in the sole portion of the bladder, and the bladder is provided with protrusion means interfitting with recess means formed in the sole portion of the foot member, whereby the protrusion means of the insert and the bladder interfit with the recess means of the sole portion of the boot member so as to restrain relative movement between the insert, the bladder and the boot member in said horizontal lane.

53. The assembly as recited in claim 45, wherein said first interfitting protrusion and recess means comprises a first set of interfitting members, namely a first upper protruding member connected to and extending downwardly from said insert, a first intermediate protruding member connected to and extending downwardly from the sole portion of the bladder, and providing a recess to receive the first upper protruding member, and a first lower recess portion formed in the sole portion of the boot member and positioned to receive the intermediate and upper first protrusion members.

54. The assembly as recited in claim 53, wherein said first upper protrusion member has in transverse cross-sectional configuration a generally V-shaped configuration, and said first intermediate protruding member and the lower first recess portion have matching V-shaped configurations.

55. The assembly as recited in claim 53, wherein said first interfitting protrusion and recess means also comprises a second set of interfitting members, namely a first upper protruding member connected to and extending downwardly from said insert, a second intermediate protruding member connected to and extending downwardly from the sole portion of the bladder, and providing a recess to receive the first upper protruding member, and a second lower recess portion formed in the sole portion of the boot member and positioned to receive the intermediate and upper first protrusion members, said first set of interfitting members being positioned adjacent a heel area of said assembly, and said second set of interfitting members being positioned forwardly of a midfoot area of said assembly.

56. The assembly as recited in claim 45, wherein said bladder has a tongue section positioned to extend over at least an upper midfoot portion of the foot, said main boot member having two side walls having upper edge portions, said tongue section having an upwardly raised middle tongue portion adapted to engage the upper edge portions of the two boot side walls, whereby the tongue section can be centered relative to the main boo member.

57. The assembly as recited in claim 56, said tongue has an upper portion which is arranged to extend over a forward ankle portion of the foot, and the raised middle tongue portion extends upwardly along the upper portion of the tongue.

58. The assembly as recited in claim 45, wherein said bladder has a tongue section -positioned to extend adjacent to a forward ankle portion of the foot, and said tongue section has a raised middle portion adapted to engage edges of two side walls of the main boot member, whereby said tongue section can be centered relative to the main boot member.

59. The assembly as recited in claim 45, wherein said bladder is formed with a tongue section having a midfoot tongue portion positioned to be adjacent an upper midfoot portion of the foot and an upper ankle tongue portion adapted to be positioned adjacent to and forwardly of an ankle portion of the foot, said bladder having an inside relief area at a location at a juncture of the midfoot tongue portion and the upper ankle tongue portion, thus permitting moderate flexing of the person's foot, without creating undue localized pressure.

60. The assembly as recited in claim 45, wherein said bladder is formed with an inside relief area positioned to be located adjacent an inner side portion of the foot adjacent a first metatarsal phalangial joint.

61. The assembly as recited in claim 45, wherein said bladder is provided with an inside relief area located at an outer forward side portion of the bladder positioned to be adjacent a fifth metatarsal phalangial joint of the foot.

62. The assembly as recited in claim 45, wherein the bladder has an inside relief area at an inside surface of a top midfoot portion of the bladder, said relief area being -positioned to be adjacent a dorsalis pedis artery and vein of the foot.

63. The assembly as recited in claim 45, wherein said bladder is formed with an inside relief area at a rear inner portion of the bladder, said relief area being positioned so as to be adjacent a posterior tibial artery of the foot.

64. The assembly as recited in claim 45, wherein said bladder is formed with the following:

a. a first inside relief area positioned to be located adjacent an inner side portion of the foot adjacent a first metatarsal phalangial joint;

b. a second inside relief area located at an outer forward side portion of the bladder positioned to be adjacent a fifth metatarsal phalangial joint of the foot;

c. a third inside relief area at an inside surface of a top midfoot portion of the bladder, said relief area being positioned to be adjacent a dorsalis pedis artery and vein of the foot;

d. a fourth inside relief area at a rear inner portion of the bladder, said relief area being positioned so as to be adjacent a posterior tibial artery of the foot.

65. The assembly as recited in claim 45, wherein said bladder is formed with a tongue section, said tongue section being further formed with right and left tongue portions which are formed with an adjustable connecting means, permitting said right and left tongue portions to be joined at a location further from each other or a location closer to each other.

66. The assembly as recited in claim 65, wherein the connecting means of said two tongue portions are formed as flap portions adapted to overlie one another, with said flap portions being formed with connecting surface portion.

67. The assembly as recited in claim 66, wherein the two flap portions of the tongue portions are formed with an upwardly raised area, positioned to engage upper edge portions of two side walls of the boot member, whereby said tongue section can be centrally positioned relative to said main boot member.

68. The assembly as recited in claim 65, wherein said tongue portions are formed with a middle raised portion adjacent the connecting means of the two tongue portions, said raised portion being positioned to engage upper edge portions of side walls of the main boot member, whereby said tongue section can be centered relative to said main boot member.

69. The assembly as recited in claim 45, wherein said main boot member has an ankle section comprising a rear boot ankle portion and side boot ankle portions, said ankle section being formed with generally horizontally extending groove means extending from the rear boot ankle portion around the side boot ankle portions.

70. The assembly as recited in claim 45, wherein the heel portion of the bladder has inwardly extending ankle engaging means to engage a rear ankle portion of a person's foot in a manner to restrain upward movement of the heel portion of the foot relative to the heel portion of the bladder, said assembly having second interfitting protrusion and recess means operatively engaged between the bladder and the boot member to restrain vertical movement of the heel portion of the bladder relative to the heel portion of the boot member.

71. The assembly as recited in claim 70, wherein the inwardly extending ankle engaging means is arranged engage a rear ankle portion of the person's foot above the heel portion of the foot and on opposite sides of an Achilles tendon of an ankle/heel portion of the foot.

72. A skate boot assembly having a longitudinal center axis, a transverse axis and a vertical axis, said assembly comprising:

a. a main boot member defining a foot receiving cavity and comprising a lower sole portion, a toe portion, a toe portion, a heel portion, and two side portions;

b. a blade which has a lengthwise blade axis and which is rigidly attached to said main boot member at a location below said sole portion, the lengthwise blade axis being aligned with, and centered on, said longitudinal center axis of the assembly;

c. a bladder adapted to be positioned in said boot cavity and made at least in part of a moderately yielding material, said bladder comprising a sole portion, and side and heel portions extending upwardly from the sole portion of the bladder;

d. an orthotic insert having a longitudinal alignment axis and adapted to be positioned in the foot receiving cavity of the boot adjacent the sole portion of the bladder, said insert having an upwardly facing surface contoured to position a plantar surface of a foot, in a manner to align the foot with the longitudinal alignment axis of the insert;

e. said assembly being arranged with first interfitting protrusion and recess means to restrain at least said orthotic insert relative to the sole portion of the boot member with regard to movement in a horizontal plane, and to align the longitudinal center axis of the boot assembly;

f. the heel portion of the bladder having inwardly extending ankle engaging means to engage a rear ankle portion of a person's foot above a heel portion of the foot and laterally adjacent an Achilles tendon of an ankle/heel portion of the foot;

g. said bladder and said boot member being provided with a second interfitting protrusion and recess means, said second interfitting protrusion and recess means being arranged to restrain upward movement of the heel portion of the bladder relative to the boot member;

whereby with the foot located in the boot assembly, the foot is positioned by the insert in a manner to support, center and align the foot with the longitudinal axis of the boot assembly, to insure proper centering with, alignment with, and support from, the skate blade.

73. The assembly as recited in claim 72, wherein said inwardly extending ankle engaging means is arranged to engage the rear ankle portion on opposite sides of the Achilles tendon.

74. A skate boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a blade which has a lengthwise blade axis and which is rigidly attached to said main boot member at a location below said sole portion, the lengthwise blade axis being aligned with, and centered on, said longitudinal center axis of the assembly;

c. a bladder adapted to be positioned in said boot cavity and made at least in part of a moderately yielding material, said bladder comprising a sole portion, and side and heel portions extending upwardly from the sole portion of the bladder;

d. an orthotic insert having a longitudinal alignment axis and adapted to be positioned in the foot receiving cavity of the boot adjacent the sole portion of the bladder, said insert having an upwardly facing surface contoured to position a plantar surface of a foot, in a manner to align the foot with the longitudinal alignment axis of the insert;

e. said assembly being arranged with first interfitting protrusion and recess means to restrain at least said orthotic insert relative to the sole portion of the boot member with regard to movement in a horizontal plane, and to align the longitudinal alignment axis of the insert with the longitudinal center axis of the boot assembly;

f. said first protrusion and recess means being characterized in that said insert is provided with protrusion means interfitting with recess means in the sole portion of the bladder, and the bladder is provided with protrusion means interfitting with recess means formed in the sole portion of the foot member, whereby the protrusion means of the insert and the bladder interfit with the recess means of the sole portion of the boot member so as to restrain relative movement between the insert, the bladder and the boot member in said horizontal plane;

whereby with the foot located in the boot assembly, the foot is positioned by the insert in a manner to support, center and align the foot with the longitudinal axis of the boot assembly, to insure proper centering with, alignment with, and support from, the skate blade.

75. A skate boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a blade which has a lengthwise blade axis and which is rigidly attached to said main boot member at a location below said sole portion, the lengthwise blade axis being aligned with, and centered on, said longitudinal center axis of the assembly;

c. a bladder adapted to be positioned in said boot cavity and made at least in part of a moderately yielding material, said bladder comprising a sole portion, and side and heel portions extending upwardly from the sole portion of the bladder;

d. an orthotic insert having a longitudinal alignment axis and adapted to be positioned in the foot receiving cavity of the boot adjacent the sole portion of the bladder, said insert having an upwardly facing surface contoured to position a plantar surface of a foot, in a manner to align the foot with the longitudinal alignment axis of the insert;

e. said assembly being arranged with first interfitting protrusion and recess means to restrain at least said orthotic insert relative to the sole portion of the boot member with regard to movement in a horizontal plane, and to align the longitudinal alignment axis of the insert with the longitudinal center axis of the boot assembly;

f. said bladder being formed with a tongue section, said tongue section being further formed with right and left tongue portions which are formed with an adjustable connecting means, permitting said right and left tongue portions to be joined at a location further from each other or a location closer to each other.

76. The assembly as recited in claim 75, wherein the connecting means of said two tongue portions are formed as flap portions adapted to overlie one another, with said flap portions being formed with a connecting surface portion.

77. The assembly as recited in claim 76, wherein the two flap portions of the tongue portions are formed with an upwardly raised area, positioned to engage upper edge portions of two side walls of the boot member, whereby said tongue section can be centrally positioned relative to said main boot member.

78. The assembly as recited in claim 75, wherein said tongue portions are formed with a middle raised portion adjacent the connecting means of the tongue portions, said raised portion being positioned to engage upper edge portions of side walls of the main boot member, whereby said tongue section can be centered relative to said main boot member.

79. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder arranged to be positioned in said boot cavity and made at least in part of a moderately yielding material, said bladder comprising a sole portion, and side and heel portions extending upwardly from the sole portion of the bladder;

c. said main boot member and said bladder being arranged with first interfitting protrusion and recess means to restrain movement of said bladder relative to the boot member;

d. said heel portion of the bladder having inwardly extending ankle engaging means to engage a rear ankle portion of a person's foot above a heel portion of the foot and on opposite sides of an Achilles tendon of an ankle/heel portion of the foot.

e. said first interfitting protrusion and recess means being arranged to restrain upward movement of the heel portion of the bladder relative to the boot member.

80. The assembly as recited in claim 79, wherein there is second interfitting protrusion and recess means arranged to restrain movement of said bladder relative to said boot member in a horizontal plane.

81. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder arranged to be positioned in said boot cavity and made at least in part of a moderately yielding material, said bladder comprising a sole portion, and side and heel portions extending upwardly from the sole portion of the bladder;

c. said main boot member and said bladder being arranged with first interfitting protrusion and recess means to restrain movement of said bladder relative to the boot member;

d. said first interfitting protrusion and recess means being arranged to restrain upward movement of the heel portion of the bladder relative to the boot member.

82. A boot assembly having a longitudinal center axis, a transverse axis and a vertical axis, said assembly comprising:

a. a main boot member defining a foot receiving cavity and comprising a lower mole portion,.a toe portion, :a heel portion, and two side portions;

b. a bladder arranged to be positioned in said boot cavity and made at least in part of a moderately yielding material, said bladder comprising a sole portion, and side and heel portions extending upwardly from the sole portion of the bladder;

c. said main boot member and said bladder being arranged with first interfitting protrusion and recess means to restrain movement of said bladder relative to the boot member;

d. said first interfitting protrusion and recess means being arranged to restrain movement of said bladder relative to said boot member in a horizontal plane, and there is second interfitting protrusion and recess means to restrain upward movement of the bladder relative to the boot member.

83. A boot assembly comprising:

a. a main boot member defining a foot receiving cavity and comprising a lower sole portion, a toe portion, a heel portion, and two side portions, said two side portions comprising side walls having upper edge portions;

b. a tongue section having an upwardly raised middle tongue portion adapted to engage the upper edge portions of the two boot side walls, whereby the tongue section can be centered relative to the boot member;

c. said tongue section extending from a toe portion of the boot, said tongue section being formed with right and left tongue portions which are formed with an adjustable connecting means, permitting said right and left tongue portions to be joined at a location further from each other or a location closer to each other.

84. The assembly as recited in claim 83, wherein the connecting means of the two tongue portions are formed as flap portions adapted to overlie one another, with said flap portions being formed with connecting surface portions.

85. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder adapted to be positioned in said boot cavity and made at least in part of a moderately yielding material, said bladder comprising a sole portion, and side and heel portions extending upwardly from the sole portion of the bladder;

c. an orthotic insert having a longitudinal alignment axis and adapted to be positioned in the foot receiving cavity of the boot above the sole portion of the bladder, said insert having an upwardly facing surface contoured to engage a plantar surface of a foot, in a manner to align the foot with the longitudinal alignment axis of the insert;

d. said assembly being arranged with first interfitting protrusion and recess means to restrain at least said orthotic insert relative to the sole portion of the boot member with regard to movement in a horizontal plane, and to align the longitudinal alignment axis of the insert with the longitudinal center axis of the boot assembly;

e. said bladder and said boot member being provided with a second interfitting protrusion and recess means, said second interfitting protrusion and recess means being arranged to restrain upward movement of the heel portion of the bladder relative to the boo member;

whereby with the foot located in the boot assembly, the foot is engaged by the insert in a manner to support, center sand align the foot with the longitudinal axis of the boot assembly.

86. The assembly as recited in claim 85, wherein the heel portion of the bladder has inwardly extending ankle engaging means to engage a rear ankle portion of a person's foot above a heel portion of the foot and on opposite sides of an Achilles tendon of an ankle/heel portion of the foot.

87. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder adapted to be positioned in said boot cavity and made at least in part of a moderately yielding material, said bladder comprising a sole portion, and side and heel portions extending upwardly from the sole portion of the bladder;

c. an orthotic insert having a longitudinal alignment axis and adapted to be positioned in the foot receiving cavity of the boot above the sole portion of the bladder, said insert having an upwardly facing surface contoured to engage a planter surface of a foot, in a manner to align the foot with the longitudinal alignment axis of the insert;

d. said assembly being arranged with first interfitting protrusion and recess means to restrain at least said orthotic insert relative to the sole portion of the boot member with regard to movement in a horizontal plane, and to align the longitudinal alignment axis of the insert with the longitudinal center axis of the boot assembly;

e. a toe portion of said bladder and the toe portion of the boot member having second interfitting protrusion and recess means to restrain relative movement between the toe portion of the bladder and the toe portion of the boot member;

whereby with the foot located in the boot assembly, the foot is engaged by the insert in a manner to support, center and align the foot with the longitudinal axis of the boot assembly.

88. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder adapted to be positioned in said boot cavity and made at least in part of a moderately yielding material, said bladder comprising a sole portion, and side and heel portions extending upwardly from the sole portion of the bladder;

c. an orthotic inset having a longitudinal alignment axis and adapted to be positioned in the foot receiving cavity of the boot above the sole portion of the bladder, said insert having an upwardly facing surface contoured to engage a plantar surface of a foot, in a manner to align the foot with the longitudinal alignment axis of the insert;

d. said assembly being arranged with first interfitting protrusion and recess means to restrain at least said orthotic insert relative to the sole portion of the boot member with regard to movement in a horizontal plane, and to align the longitudinal alignment axis of the insert with the longitudinal center axis of the boot assembly;

e. said first protrusion and recess means being characterized in that said insert is provided with protrusion means interfitting with recess means in the sole portion of the bladder, and the bladder is provided with protrusion means interfitting with recess means formed in the sole portion of the boot member;

whereby the protrusion means of the insert and the bladder interfit with the recess means of the sole portion of the boot member so as to restrain relative movement between the insert, the bladder and the boot member in said horizontal plane.

89. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder adapted to be positioned in said boot cavity and made at least in part of a moderately yielding material, said bladder comprising a sole portion, and side and heel portions extending upwardly from the sole portion of the bladder;

c. an orthotic insert having a longitudinal alignment axis and adapted to be positioned in the foot receiving cavity of the boot above the sole portion of the bladder, said insert having an upwardly facing surface contoured to engage a plantar surface of a foot, in a manner to align the foot with the longitudinal alignment axis of the insert;

d. said assembly being arranged with first interfitting protrusion and recess means to restrain at least said orthotic insert relative to the sole portion of the boot member with regard to movement in a horizontal plane, and to align the longitudinal alignment axis of the insert with the longitudinal center axis of the boot assembly;

e. said first interfitting protrusion and recess means comprising a first set of interfitting members, namely a first upper protruding member connected to and extending downwardly from said insert, a first intermediate protruding member connected to and extending downwardly from the sole portion of the bladder, and providing a recess to recess the first upper protruding member, and a first lower recess portion formed in the sole portion of the boot member and positioned to receive the intermediate and upper first protrusion members;

whereby the protrusion means of the insert and the bladder interfit with the recess means of the sole portion of the boot member so as to restrain relative movement between the insert, the bladder and the boot member in said horizontal plane.

90. The assembly as recited in claim 89, wherein said first upper protrusion member has in transverse cross-sectional configuration a generally V-shaped configuration, and said first intermediate protruding member and the lower first recess portion have matching V-shaped configurations.

91. The assembly as recited in claim 89, wherein said first interfitting protrusion and recess means also comprises a second set of interfitting members, namely a first upper protruding member connected to and extending downwardly from said insert, a second intermediate protruding member connected to and extending downwardly from the sole portion of the bladder, and providing a recess to receive the first upper protruding member, and a second lower recess portion formed in the sole portion of the boot member and positioned to receive the intermediate and upper first protrusion members, said first set of interfitting members being positioned adjacent a heel area of said assembly, and said second set of interfitting members being positioned forwardly of a midfoot area of said assembly.

92. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder adapted to be positioned in said boot cavity and made at least in part of a moderately yielding material, said bladder comprising a sole portion, and side and heel portions extending upwardly from the sole portion of the bladder;

c. an orthotic insert having a longitudinal alignment axis and adapted to be positioned in the foot receiving cavity of the boot above the sole portion of the bladder, said inset having an upwardly facing surface contoured to engage a plantar surface of a foot, in a manner to align the foot with the longitudinal alignment axis of the insert;

d. said assembly being arranged with first interfitting protrusion and recess means to restrain at least said orthotic insert relative to the sole portion of the boot member with regard to movement in a horizontal plane, and to align the longitudinal alignment axis of the insert with the longitudinal center axis of the boot assembly;

e. said bladder being formed with a tongue section extending rearwardly from a toe portion of said bladder, said tongue section being further formed with right and left tongue poritons which are formed with an adjustable connecting means, permitting said right and left tongue portions to be joined at a location further from each other or a location closer to each other;

whereby with the foot located in the boot assembly, the foot is engaged by the insert in a manner to support, center and align the foot with the longitudinal axis of the boot assembly.

93. The assembly as recited in claim 92, wherein the connecting means of said two tongue portions are formed as flap portions adapted to overlie one another, with said flap portions being formed with a connecting surface portion.

94. The assembly as recited in claim 93, wherein the two flap portions of the tongue portions are formed with an upwardly raised area, positioned to engage upper edge portions of two side walls of the boot member, whereby said tongue section can be centrally positioned relative to said main boot member.

95. The assembly as recited in claim 92, wherein said tongue portions are formed with a middle raised portion adjacent the connecting means of the two tongue portions, said raised portion being positioned to engage upper edge portions of side walls of the main boot member, whereby said tongue section can be centered relative to said main boot member.

96. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder adapted to be positioned in said boot cavity and made at least in part of a moderately yielding material, said bladder comprising a sole portion, and side and heel portions extending upwardly from the sole portion of the bladder;

c. an orthotic insert having a longitudinal alignment axis and adapted to be positioned in the foot receiving cavity of the boot above the sole portion of the bladder, said insert having an upwardly facing surface contoured to engage a planter surface of a foot, in a manner to align the foot with the longitudinal alignment axis of the insert;

d. said assembly being arranged with first interfitting protrusion and recess means to restrain at least said orthotic insert relative to the sole portion of the boot member with regard to movement in a horizontal plane, and to align the longitudinal alignment axis of the insert with the longitudinal center axis of the boot assembly;

e. said heel portion of the bladder having inwardly extending ankle engaging means to engage a rear ankle portion of a person's foot in a manner to restrain upward movement of the heel portion of the foot relative to the heel portion of the bladder, said assembly having second interfitting protrusion and recess means operatively engaged between the bladder and the boot member to restrain vertical movement of the heel portion of the bladder relative to the heel portion of the boot member;

whereby with the foot located in the boot assembly, the foot is engaged by the insert in a manner to support, center and align the foot with the longitudinal axis of the boot assembly.

97. The assembly as recited in claim 96, wherein the inwardly extending ankle engaging means is arranged to engage a rear ankle portion of the person's foot above the heel portion of the foot and on opposite sides of an Achilles tendon of an ankle/heel portion of the foot.

98. A skate boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a blade which has a lengthwise blade axis and which is rigidly attached to said main boot member at a location below said sole portion, the lengthwise blade axis being aligned with, and centered on, said longitudinal center axis of the assembly;

c. a bladder adapted to be positioned in said boot cavity and made at least in part of a moderately yielding material, said bladder comprising a sole portion, and side and heel portions extending upwardly form the sole portion of the bladder;

d. an orthotic insert having a longitudinal alignment axis and adapted to be positioned in the foot receiving cavity of the boot adjacent the sole portion of the bladder, said insert having an upwardly facing surface contoured to position a plantar surface of a foot, in manner to align the foot with the longitudinal alignment axis of the insert;

e. said assembly being arranged with first interfitting protrusion and recess means to restrain upward movement of the heel portion of the bladder relative to said boot member; where said first interfitting protrusion an recess means is arrange in a manner that with a person's foot being positioned in said boot assembly, said first interfitting and protrusion means is positioned to restrain upward movement of said bladder, said protrusion and recess means being further arranged in a manner that without the person's foot being positioned in the boot assembly the protrusion and recess means is positioned to permit the bladder and the insert to be removed from the boot assembly.

99. The assembly as recited in claim 98, wherein the heel portion of the bladder has inwardly extending ankle engaging means to engage a rear ankle portion of a person's foot above a heel portion of the foot and laterally adjacent an Achilles tendon of an ankle/heel portion of the foot.

100. The assembly as recite in claim 99, wherein said inwardly extending ankle engaging means is arranged to engage the rear ankle portion on opposite sides of the Achilles tendon.

101. A boot assembly having a longitudinal center axis, a transverse axis and a vertical axis, said assembly comprising:

a. a main boot member defining a foot receiving cavity and comprising a lower sole portion, a toe portion, a heel portion, and two side portions;

b. a bladder adapted to be positioned in said boot cavity and made at least in part of a moderately yielding material, said bladder comprising a sole portion, and side and heel portions extending upwardly from the sole portion of the bladder;

c. an orthotic insert having a longitudinal alignment axis and adapted to be positioned in the foot receiving cavity of the boot above the sole portion of the bladder, said insert having an upwardly facing surface contoured to engage a plantar surface of a foot, in a manner to align the foot with the longitudinal alignment axis of the insert;

d. said assembly being arranged with first interfitting protrusion and recess means to restrain upward movement of the heel portion of the bladder relative to said boot member;

whereby with the foot located in the boot assembly, the foot is engaged by the insert in a manner to support, center and align the foot with the longitudinal axis of the boot assembly; wherein said first interfitting protrusion and recess means is arranged in a manner that with a person's foot being positioned in said boot assembly, said first interfitting and protrusion means is positioned to restrain upward movement of said bladder, said protrusion and recess means being further arranged in a manner that without the person's foot being positioned in the boot assembly the protrusion and recess means are positioned to permit the bladder and the insert to be removed from the boot assembly.

102. The assembly as recited in claim 101, wherein the heel portion of the bladder has inwardly extending ankle engaging means to engage a rear ankle portion of a person's foot above a heel portion of the foot and laterally adjacent an Achilles tendon of an ankle/heel portion of the foot.

103. The assembly as recited in claim 102, wherein said inwardly extending ankle engaging means is arranged to engage the rear ankle portion on opposite sides of the Achilles tendon.

104. The assembly as recited in claim 101, wherein a toe portion of said bladder and the toe portion of the boot member have second interfitting protrusion and recess means to restrain relative movement between the toe portion of the bladder and the toe portion of the boot member.

105. The assembly as recited in claim 101, wherein said bladder has a tongue section positioned to extend over at least an upper midfoot portion of the foot, said main boot member having two side walls having upper edge portions, said tongue section having an upwardly raised middle tongue portion adapted to engage the upper edge portions of the two boot side walls, whereby the tongue section can be centered relatives to the main boot member.

106. The assembly as recited in claim 105, wherein said tongue has an upper portion which is arranged to extend over a forward ankle portion of the foot, and the raised middle tongue portion extends upwardly along the upper portion of the tongue.

107. The assembly as recited in claim 101, wherein said bladder is formed with a tongue section having a midfoot tongue portion positioned to be adjacent an upper midfoot portion of the foot and an upper ankle tongue portion adapted to be positioned adjacent to and forwardly of an ankle portion of the foot, said bladder having an inside relief area at a location at a juncture of the midfoot tongue portion and the upper ankle tongue portion, thus permitting moderate flexing of the person's foot, without creating undue localized pressure.

108. The assembly as recited in claim 101, wherein said bladder is formed with an inside relief area positioned to be located adjacent an inner side portion of the foot adjacent a first metatarsal phalangial joint.

109. The assembly as recited in claim 101, wherein said bladder is provided with an inside relief area located at an outer forward side portion of the bladder positioned to be adjacent a fifth metatarsal phalangial joint of the foot.

110. The assembly as recited in claim 101, wherein the bladder has an inside relief area at an inside surface of a top midfoot portion of the bladder, said relief area being positioned to be adjacent a dorsalis pedis artery and vein of the foot.

111. The assembly as recited in claim 101, wherein said bladder is formed with an inside relief area at a rear inner portion of the bladder, said relief area being positioned so as to be adjacent a posterior tibial artery of the foot.

112. The assembly as recited in claim 101, wherein said bladder is formed with the following:

a. a first inside relief area positioned to be located adjacent an inner side portion of the foot adjacent a first metatarsal phalangial joint;

b. a second inside relief area located at an outer forward side portion of the bladder positioned to be adjacent a fifth metatarsal phalangial joint of the foot;

c. a third inside relief area at an inside surface of a top midfoot portion of the bladder, said relief area being positioned to be adjacent a dorsalis pedis artery and vein of the foot;

d. a fourth inside relief area at a rear inner portion of the bladder, said relief area being positioned so as to be adjacent a posterior tibial artery of the foot.

113. The assembly as recited in claim 101, wherein said bladder is formed with a tongue section, said tongue section being further formed with right and left tongue portions which are formed with an adjustable connecting means, permitting said right and left tongue portion to be joined at a location further from each other or a location closer to each other.

114. The assembly as recited in claim 113, wherein the connecting means of said two tongue portions are formed as flap portions adapted to overlie one another, with said flap portions being formed with connecting surface portion.

115. The assembly as recited in claim 114, wherein the two flap portions of the tongue portions are formed with an upwardly raised area, positioned to engage upper edge portions of two side walls of the boot member, whereby said tongue section can be centrally positioned relative to said main boot member.

116. The assembly as recited in claim 115, wherein said tongue portions are formed with a middle raised portion adjacent the connecting means of the two tongue portions, said raised portion being positioned to engage upper edge portions of side walls of the main boot member, whereby said tongue section can be centered relative to said main boot member.

* * * * *